US009983510B2

(12) United States Patent
Matsumoto et al.

(10) Patent No.: US 9,983,510 B2
(45) Date of Patent: May 29, 2018

(54) DEVELOPING DEVICE AND IMAGE FORMING APPARATUS HAVING DEVELOPER CARRYING AND STIRRING CONTROL

(71) Applicant: CANON KABUSHIKI KAISHA, Tokyo (JP)

(72) Inventors: Atsushi Matsumoto, Toride (JP); Kyosuke Takahashi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/353,812

(22) Filed: Nov. 17, 2016

(65) Prior Publication Data

US 2017/0115602 A1 Apr. 27, 2017

Related U.S. Application Data

(63) Continuation of application No. PCT/JP2015/065486, filed on May 22, 2015.

(30) Foreign Application Priority Data

May 23, 2014 (JP) ..... 2014-107077

(51) Int. Cl.
*G03G 15/08* (2006.01)

(52) U.S. Cl.
CPC ..... *G03G 15/0889* (2013.01)

(58) Field of Classification Search
CPC ..... G03G 15/0889; G03G 15/0891; G03G 2215/0819; G03G 2215/085; G03G 2215/0852

(Continued)

(56) References Cited

U.S. PATENT DOCUMENTS 7,917,066 B2 3/2011 Ootsuka
9,031,434 B2 * 5/2015 Tsukada ..... G03G 15/0891 399/256

(Continued)

FOREIGN PATENT DOCUMENTS

JP S59-100471 A 6/1984
JP 06-075466 A 3/1994

(Continued)

OTHER PUBLICATIONS

PCT International Search Report and the Written Opinion dated Jul. 28, 2015, in PCT/JP2015/065486.

(Continued)

*Primary Examiner* — Billy Lactaoen
(74) *Attorney, Agent, or Firm* — Fitzpatrick, Cella, Harper & Scinto

(57) ABSTRACT

A developing device includes a developing container accommodating a developer including toner and magnetic particles, a developer carrying member rotatably provided opposed to an opening of the developing container, a stirring member configured to stir the developer in the developing container to supply the developer to the developer carrying member, a first driving device configured to drive the developer carrying member, and a second driving device configured to drive the stirring member. A controller controls drive of the first driving device and the second driving device so that in a period from output of either earlier one of a stop signal of the first driving device and a stop signal of the second driving device to rotational speeds of both of the developer carrying member and the stirring member becoming not more than ½ of rotational speeds in a steady state during image formation.

33 Claims, 17 Drawing Sheets

(58) Field of Classification Search
USPC ..... 399/254, 253
See application file for complete search history.

(56) References Cited

U.S. PATENT DOCUMENTS

| | | | | |
|---|---|---|---|---|
| 2010/0098447 | A1* | 4/2010 | Ootsuka ..... | G03G 15/0887 399/53 |
| 2011/0142465 | A1 | 6/2011 | Ootsuka | |

FOREIGN PATENT DOCUMENTS

| | | | |
|---|---|---|---|
| JP | 2010-101980 | A | 5/2010 |
| JP | 2010-112973 | A | 5/2010 |
| JP | 2012-237785 | A | 12/2012 |
| JP | 2013-088687 | A | 5/2013 |
| JP | 2013-145294 | A | 7/2013 |
| JP | 2014-056267 | A | 3/2014 |

OTHER PUBLICATIONS

Atsushi Matsumoto et al., U.S. Appl. No. 15/354,020, filed Nov. 17, 2016.

* cited by examiner (a)

(b)

DEVELOPING DEVICE AND IMAGE FORMING APPARATUS HAVING DEVELOPER CARRYING AND STIRRING CONTROL

This application is a continuation of PCT Application No. PCT/JP2015/065486, filed on May 22, 2015.

TECHNICAL FIELD

The present invention relates to an image forming apparatus including a developing device for forming a visible image by developing an electrostatic latent image formed on an image bearing member by an electrophotographic type, an electrostatic recording type, or the like.

BACKGROUND ART

In recent years, with an increasing demand of color copying in an office, a high-speed and downsized full-color copying machine is required, and a method of using a vertical stirring developing device in which two developing screws are vertically placed has been proposed. In such a vertical stirring developing device, a developer is circulated between the vertically placed two screws. However, power of supplying the developer from a lower screw toward an upper screw largely depends on driving stops of the screws, and therefore, with respect to the image forming apparatus having particularly a plurality of image forming stops, a developing sleeve and the two screws are provided with separate driving sources, respectively, in many cases (Japanese Laid-Open Patent Application 2010-112973).

SUMMARY OF THE INVENTION

Problems to be Solved by the Invention

However, as described above, the developing device having a separate drive constitution for the developing sleeve and the two screws (hereinafter simply referred to as "stirring screw(s)" involves the following problem. During drive stop of the developing device, developer circulation is out of balance in many cases, and in some instances, the developer cannot be sufficiently supplied to the developing sleeve, and the developer on the developing sleeve becomes insufficient, whereby image density non-uniformity is generated in some cases.

Thus, as a factor of the out-of-balance developer circulation during drive stop of the developing device, it is possible to cite and differ in manner of drive stop resulting from a difference in moment of inertia between the stirring screw and the developing sleeve. That is, the moment of inertia of the stirring screw and the moment of inertial of the developing sleeve are different from each other, so that angular acceleration is different and a rotational frequency (number of revolutions) until the drive stops largely differs from that in a steady state between the stirring screw and the developing sleeve. In general, compared with the developing sleeve, the stirring screw is small in moment of inertia. For this reason, as shown in Comparison Example 1 of (a) to (c) of FIG. 6, a time from a time t1 when a drive stop signal generates to a time t3 when the stirring screw stops in actuality is shorter than a time t4 when the developing sleeve stops.

This means that the developing sleeve large in moment of inertial rotates "compared with the steady state" more than the stirring screw small in moment of inertial during drive stop. With this rotation, a developer stagnation amount at a developing blade portion is smaller during drive stop than in the steady state.

For this reason, during drive stop, there is a liability that improper developing coating due to the developer stagnation becomes small during drive stop (or that the developer stagnation completely loses) generates. As a countermeasure against this, as in Japanese Laid-Open Patent Application 2010-101980, the drive stop signal of the stirring screw is intentionally delayed compared with that of the developing sleeve. By this, a method in which supply of the developer to the developing sleeve during drive stop is made abundant and improper coating of the developer is suppressed would be considered (see Comparison Example 2 shown in (a) to (c) of FIG. 7).

However, according to this method, the stirring screw continuously rotates excessively until the developing sleeve stops in actuality. Particularly during an intermittent operation of the copying machine, an increase in driving time of the stirring screw causes deterioration of the developer and deterioration of a shaft end portion seal of the stirring screw, so that there is a large possibility that the deterioration leads to a lowering in lifetime of the developing device.

Further, there is an image forming apparatus in which a lowering in charging property of the developer is suppressed by supplying a developer consisting of toner and a carrier as represented by a trickle developing type as in Japanese Laid-Open Patent Application Sho 59-100471. In this apparatus, a discharge opening for permitting discharge of an excessive developer, in the developing device, which becomes excessive by the supply is provided. For this reason, a developer circulation balance during drive stop has to be strictly managed (controlled).

Incidentally, the trickle developing type is such that the carrier is mixed in the toner in a toner cartridge at a certain ratio, and a new (fresh) carrier is supplied into a developing device simultaneously with the toner supply, so that the developer is replaced so as to discharge a deteriorated old carrier. By this, less deteriorated carrier continuously remains in the developing device, so that the deterioration of the developer is prevented for a long term.

Here, the deterioration of the developer means such that by collision between the toner and the developing sleeve or between toners (toner particles), breakage of a projected portion of the toner generates and burying of an external additive existing on a toner surface in the toner surface generates. In the case where the developer deterioration is generated, the external additive such as silica added to improve flowability of the toner is buried in the toner surface, whereby a toner depositing force increases and the flowability lowers.

The present invention solves the above-described problem, and an object thereof is to provide a developing device suppressing out of balance of developer circulation in the developing device in which a developer carrying member and a stirring member are separately driven.

Means for Solving the Problem

According to an aspect of the present invention, there is provided a developing device comprising: a developing container configured to accommodate a developer including toner and magnetic particles; a developer carrying member rotatably provided opposed to an opening of the developing container; a stirring member configured to stir the developer in the developing container to supply the developer to the developer carrying member; a first driving device configured to drive the developer carrying member; a second driving member configured to drive the stirring member; and a controller configured to control drive of the first driving device and the second driving device, wherein the controller effects control so that in a period from output of either earlier one of a stop signal of the first driving device and a stop signal of the second driving device to rotational speeds of both of the developer carrying member and the stirring member becoming not more than ½ of rotational speeds in a steady state during image formation, the following formula is satisfied: $0.7<\alpha(E)/\alpha<2.0$, where the $\alpha(E)$ is $\omega a(E)/\omega s(E)$ wherein $\omega s(E)$ is a rotational speed of the developer carrying member and $\omega a(E)$ is a rotational speed of the stirring member, where the $\alpha$ is $\omega a/\omega s$ wherein $\omega s$ is a rotational speed of the developer carrying member in the steady state during the image formation and $\omega a$ is a rotational speed of the stirring member in the steady state during the image formation.

Effect of the Invention

According to the above-described constitution, a rotational speed ratio between the developer carrying member and the stirring member during drive stop is brought near to the rotational speed ratio during image formation. By this, it is possible to suppress out-of-balance developer circulation.

EMBODIMENTS FOR CARRYING OUT THE INVENTION

An embodiment of an image forming apparatus including a developing device according to the present invention will be specifically described by the drawings.

Embodiment 1

Figure 1:
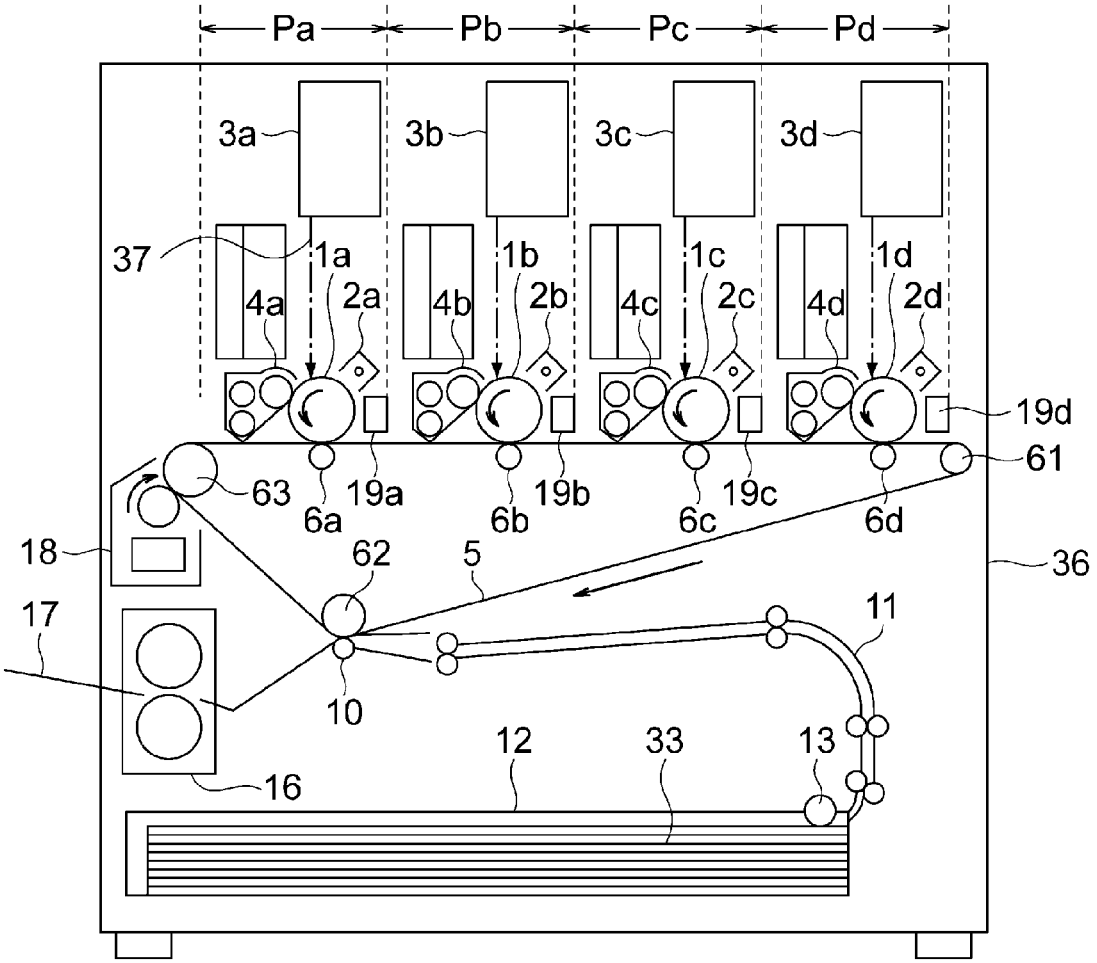
FIG. 1 is a sectional illustration showing a structure of an image forming apparatus including a developing device according to the present invention.

First, a constitution of the First Embodiment of the image forming apparatus including the developing device according to the present invention will be described using FIGS. 1-11. FIG. 1 is a sectional illustration of a full-color image forming apparatus, employing an electrophotographic type, which is the embodiment of the image forming apparatus including the developing device according to the present invention. Incidentally, as the image forming apparatus, the present invention is applicable to a copying machine, a printer, a recording image display apparatus, a facsimile device, and the like.

<Image Forming Apparatus>

In FIG. 1, an image forming apparatus 36 in this embodiment includes four image forming portions Pa, Pb, Pc, Pd of yellow, magenta, cyan, black which are image forming means. Incidentally, for convenience of explanation, description is made in some cases using simply an image forming portion P as a representative of the image forming portions Pa, Pb, Pc, Pd. Also other image forming process means will be similarly described. The respective image forming portions P include photosensitive drums 1*a*, 1*b*, 1*c*, 1*d* consisting of drum-shaped electrophotographic photosensitive members, rotating in arrow directions (counterclockwise direction) of FIG. 1, which are image bearing members for bearing electrostatic latent images.

At peripheries of the respective photosensitive drums, chargers 2*a*, 2*b*, 2*c*, 2*d* as charging means and laser beam scanners 3*a*, 3*b*, 3*c*, 3*d* as image exposure means are provided above the photosensitive drums 1 in FIG. 1. Further, developing devices 4*a*, 4*b*, 4*c*, 4*d* as developing means for forming toner images by supplying developers to the electrostatic latent images carried on surfaces of the respective photosensitive drums 1 are provided. Further, image forming means consisting of primary transfer rollers 6*a*, 6*b*, 6*c*, 6*d* as primary transfer means, cleaning devices 19*a*, 19*b*, 19*c*, 19*d* as cleaning means, and the like are included.

The respective image forming portions P have a similar constitution, and the photosensitive drums 1 disposed in the respective image forming portions P have the same constitution. Accordingly, the photosensitive drums 1 will be described simply as the photosensitive drum 1 as a representative of the photosensitive drums 1*a*, 1*b*, 1*c*, 1*d*. Similarly, also the chargers 2, the laser beam scanners 3, the developing devices 4, the primary transfer rollers 6 and the cleaning devices 19 which are disposed at the respective image forming portions P have the same constitutions, respectively, at the respective image forming portions P. Therefore, these members will be described using the charger 2, the laser beam scanner 3, the developing device 4, the primary transfer roller 6 and the cleaning device 19, respectively.

<Image Forming Sequence>

Next, an image forming sequence of an entirety of the image forming apparatus 36 will be described. First, the surface of the photosensitive drum 1 is electrically charged uniformly by the charger 2. The uniformly charged photosensitive drum 1 at the surface thereof is subjected to scanning exposure by the laser beam scanner 3 to laser light 37 modulated by an image signal.

The laser beam scanner 3 incorporates therein a semiconductor laser. This semiconductor laser is controlled correspondingly to an original image information signal outputted from an original reader including a photoelectric conversion element such as a CCD (charge coupled device) or the like, and emits the laser light 37.

By this, a surface potential of the photosensitive drum 1 charged by the charger 2 changes at an image portion, so that an electrostatic latent image is formed on the surface of the photosensitive drum 1. This electrostatic latent image is reversely developed by the developing device 4 into a visible image, i.e., a toner image. In this embodiment, the developing device 4 uses, as a developer, a two-component contact development type in which a two-component developer containing the toner and a carrier is used in mixture. Further, the above-described image forming steps are performed at every one of the image forming portions P, so that four color toner images of yellow, magenta, cyan, black are formed on the surfaces of the photosensitive drums 1.

In this embodiment at positions under the image forming portions P in FIG. 1, an intermediary transfer belt 5 which is an intermediary transfer member is provided. The intermediary transfer belt 5 is stretched by rollers 61, 62, 63 and is movable in an arrow direction in FIG. 1.

The toner images on the surfaces of the photosensitive drums 1 are primary-transferred onto an outer peripheral surface of the intermediary transfer belt 5 as the intermediary transfer member by the primary transfer rollers 6 as the primary transfer means. By this, the four color toner images of yellow, magenta, cyan, black are superposed on the outer peripheral surface of the intermediary transfer belt 5, so that a full-color image is formed. Further, the toner remaining on the surface of the photosensitive drum 1 without being transferred onto the intermediary transfer belt 5 is scraped off and collected by the cleaning device 19.

Figure 2:
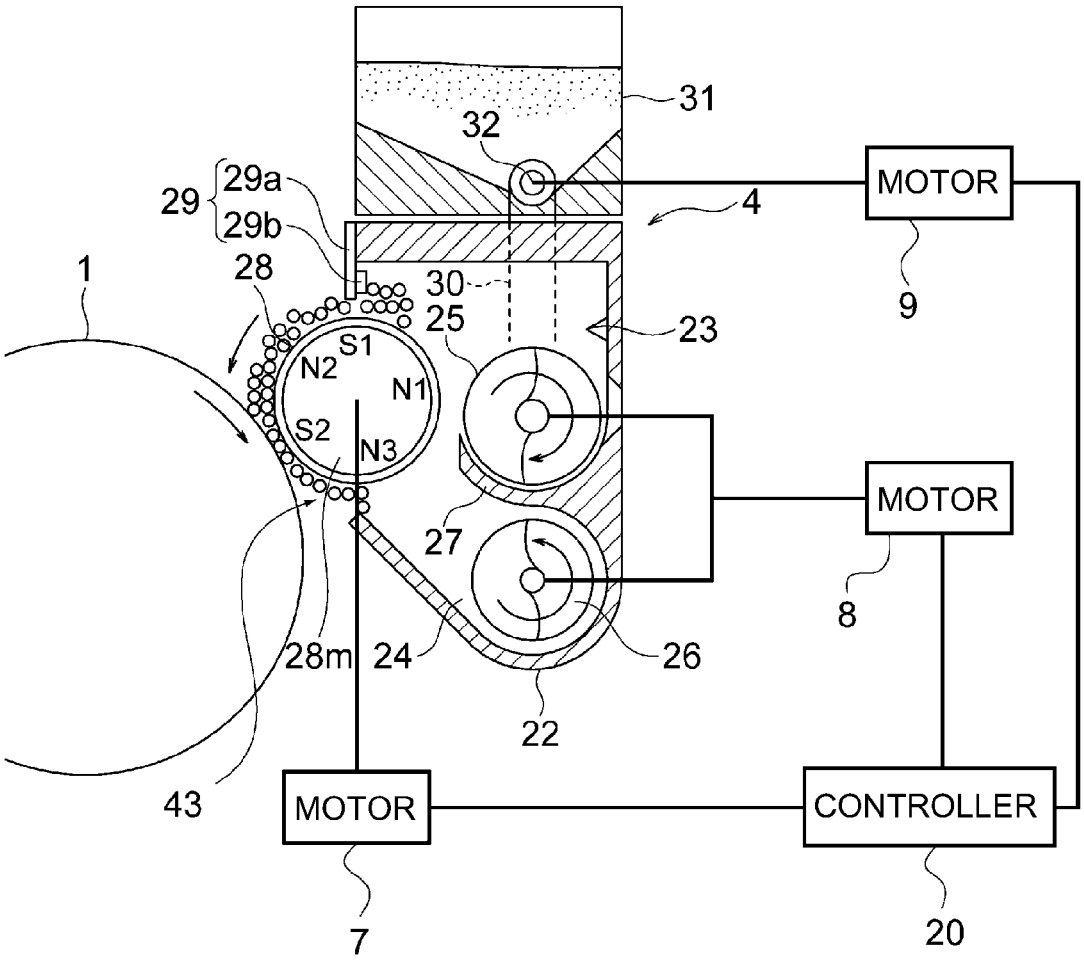
FIG. 2 is a longitudinal sectional illustration showing a structure of the developing device according to the present invention.
Figure 3:
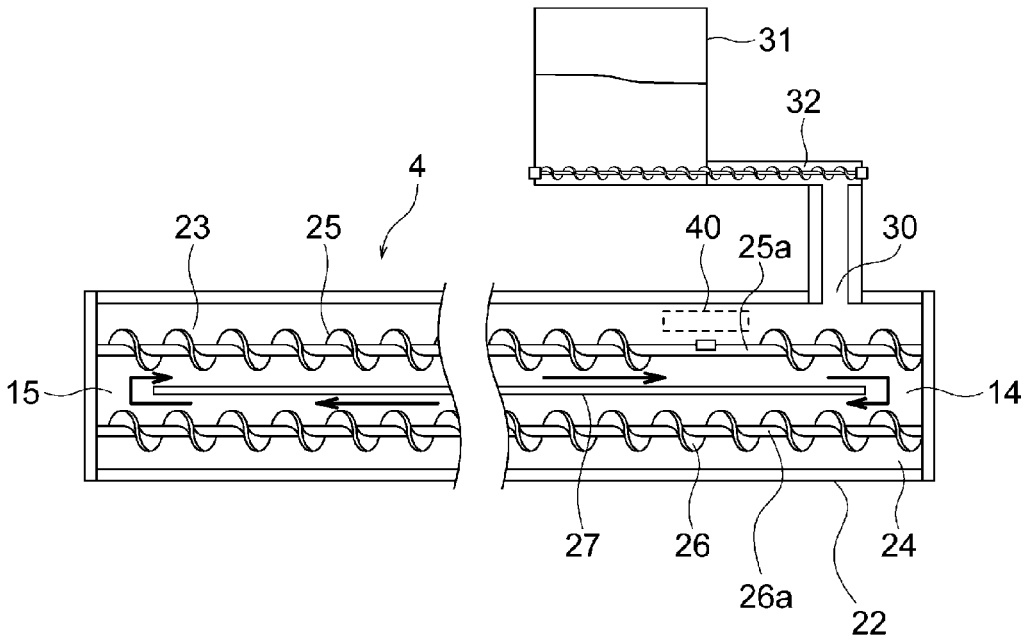
FIG. 3 is a cross-sectional illustration showing a structure of the developing device according to the present invention.

The full-color image primary-transferred on the surface of the intermediary transfer belt 5 is secondary-transferred by the action of a FIG. 2 and FIG. 3 are cross-sectional and longitudinal sectional illustrations of the developing device 4 according to this embodiment. As shown in FIG. 2 and FIG. 3, the developing device 4 in this embodiment includes a developing container 22 for accommodating the two-component developer including the toner and magnetic particles (carrier). In the developing container 22, the two-component developer containing the toner and the carrier is accommodated. In addition, in the developing container 22, a developing sleeve 28 as a developer carrying member rotatably provided opposed to an opening 43 of the developing container 22 is included. Further, a regulating blade 29 as a chain-cutting member for regulating a chain of the developer carried on the surface of the developing sleeve 28 is included.

As shown in FIG. 3, inside the developing container 22, a partition wall 27 extending in a perpendicular direction to the drawing sheet surface of FIG. 3 at a substantially central portion is provided. The inside of the developing container 22 is vertically partitioned by the partition wall 27 into a developing chamber 23 and a stirring chamber 24 in FIG. 2 and FIG. 3. The developing chamber 23 is constituted as a first accommodating chamber. The stirring chamber 24 is constituted as a second accommodating chamber for not only accommodating the developer but also collecting the developer from the developing sleeve 28. The developer is accommodated in the secondary transfer roller 10 as a secondary transfer means onto a recording material 33 such as paper or the like which is fed from a feeding cassette 12 by a feeding roller 13 and which is conveyed via a feeding guide 11. The toner remaining on the outer peripheral surface of the intermediary transfer belt 5 without being transferred onto the recording material 33 is scraped off and collected by the cleaning device 18 as the cleaning means.

On the other hand, the recording material 33 on which the toner image on the outer peripheral surface of the intermediary transfer belt 5 is transferred is sent to a fixing device 16 consisting of a heating roller fixing device as a fixing means, and the toner image is fixed on the recording material 33 by being heated and pressed by the fixing device 16. Thereafter, the recording material 33 is discharged onto a discharge tray 17.

Incidentally, in this embodiment, as the image bearing member, the photosensitive drum 1 which is a drum-shaped organic photosensitive member which is ordinarily used was used. It is also possible to use, as another one, an inorganic photosensitive member such as an amorphous silicon photosensitive member. Further, it is also possible to use a belt-shaped photosensitive member. Also as regards the charging type, the transfer type, the cleaning type and the fixing type, they are not limited to those in this embodiment.

[Developing Device]

Next, a constitution and an operation of the developing device 4 will be described using FIGS. 2 and 3. In addition, in the developing container 22, developing chamber 23 and the stirring chamber 24.

In the developing chamber 23 and the stirring chamber 24, a first stirring member for stirring the developer in the developing container 22 (developing container) and for supplying the developer to the developing sleeve 28 is provided. Further, first and second stirring screws 25, 26 as a second stirring member for stirring the developer in the developing container 22 (developing container) and for collecting the developer from the developing sleeve 28 are provided.

The first and second stirring screws 25, 26 are provided in the developing chamber 23 and the stirring chamber 24 (in the first and second developer accommodating chambers), respectively, and not only stir and feed the developer in the developing chamber 23 and the stirring chamber 24 but also effect circulation of the developer between the developing chamber 23 and the stirring chamber 24. The developing chamber 23 is provided with a discharge opening 40 for permitting discharge of an excessive developer generated with supply of the developer including the toner and magnetic particles (carrier), by rising of a developer surface (upper surface of the developer).

The first feeding screw 25 provided in the developing chamber 23 is disposed, at the bottom (portion) of the developing chamber 23, substantially in parallel to an axial direction of the developing sleeve 28. Further, the first feeding screw 25 rotates in an indicated arrow direction (clockwise direction) in FIG. 2, and supplies the developer in the developing chamber 23 to the developing sleeve 28 and feeds the developer in one direction along the axial direction of the first feeding screw 25.

Further, the second stirring screw 26 provided in the stirring chamber 24 is disposed, at the bottom (portion) of the stirring chamber 24, substantially in parallel to the first stirring screw 25. Further, as shown in FIG. 2, the second stirring screw 26 rotates in an opposite direction (counterclockwisely) to the rotational direction of the first stirring screw 25 and collects the developer after being subjected to the development, and feeds the developer in the stirring chamber 24 in the direction opposite to that of the first stirring screw 25. Thus, by the feeding of the developer through the rotation of the first and second stirring screws 25 and 26, the developer is circulated between the developing chamber 23 and the stirring member 24 through communicating portions consisting of openings 14, 15 formed at both ends of the partition wall 27.

This embodiment is an example in which the developing chamber 23 and the stirring chamber 24 are vertically disposed in FIG. 2 and FIG. 3. As another example, when a room from which the developer is supplied to the developing sleeve 28 and a room into which the developer is collected from the developing sleeve 28 are separate members, this embodiment is similarly applicable to a developing device 4 in which the developing chamber 23 and the stirring chamber 24 are horizontally juxtaposed or other developing devices 4 having various forms.

<Constitution of Drive Control System>

Next, a constitution of a drive control system of the developing device 4 will be described. The developing sleeve 28 is rotationally driven by a motor 7 as a first driving means, and the first and second stirring screws 25, 26 as the stirring member are rotationally driven by a motor 8 as a second driving means. In this embodiment, the motors 7, 8 are drive-controlled by a controller 20 as a control means. The motors 7, 8 use a stepping motor capable of setting angular acceleration by an acceleration/deceleration rate during drive stop. The acceleration/deceleration rate is a gradient of a rotational speed until the motors 7, 8 actuate from a rest (stop) state and speeds thereof reach certain stops or a gradient of a rotational speed until the motors 7, 8 completely stop by receiving stop signals in rotation states thereof.

The rotational speeds of the motors 7, 8 in steady states during image formation were 565 rpm (rotation per minute) and 900 rpm, respectively. Further, in this embodiment, the motors 7, 8 are directly connected with the developing sleeve 28 and the first stirring screw 25, respectively, and further to the first stirring screw 25 and the second stirring screw 26, a rotational driving force is transmitted via an unshown gear train. For this reason, also the developing sleeve 28 and the first stirring screw 25 are rotationally driven at 565 rpm and 900 rpm, respectively, and the second stirring screw 26 is rotationally driven at 950 rpm on the basis of a gear ratio of the unshown gear train. Incidentally, image formation in this embodiment refers to the time when the image to be formed on the recording material passes through a developing region where the developing sleeve 28 and the photosensitive drum 1 oppose each other.

In this embodiment, the developing container 22 is provided with the opening 43 at a position corresponding to a developing region where the developing container 22 opposes the photosensitive drum 1, and at this opening 43, the developing sleeve 28 is rotatably disposed so as to partly expose toward the photosensitive drum 1. An outer diameter of the developing sleeve 28 is 20 mm and is rotationally driven at a peripheral speed of 565 rpm. An outer diameter of the photosensitive drum 1 is 30 mm and is rotationally driven at a peripheral speed of 217 rpm. Further, the closest region between the developing sleeve 28 and the photosensitive drum 1 is set at a spacing distance of about 400 μm. By this, setting is made so that the development can be effected in a state in which the developer fed to the developing portion where the developing sleeve 28 and the photosensitive drum 1 oppose each other is contacted to the photosensitive drum 1.

The developing sleeve 28 in this embodiment is formed of non-magnetic material such as aluminum and stainless steel, and inside thereof, a magnetic roller 28*m* as a magnetic field generating means is disposed in a non-rotatable state. The developing sleeve 28 rotates in the direction indicated by an arrow (counterclockwise direction) in FIG. 2. The developing sleeve 28 carries a layer thickness-regulated two-component developer by cutting of a chain of a magnetic brush with the regulating blade 29. The developing sleeve 28 feeds the developer to the developing region in which the developing sleeve 28 opposes the photosensitive drum 1, and supplies the developer to the electrostatic latent image formed on the photosensitive drum 1, and develops the electrostatic latent image as the toner image.

The regulating blade 29 is constituted by a non-magnetic member 29*a* formed with an aluminum plate or the like extending in a longitudinal axial direction of the developing sleeve 28 and by a magnetic member 29*b* such as an iron material. Further, by adjusting a gap between the regulating blade 29 and the developing sleeve 28, an amount of the developer fed to the developing region is adjusted. In this embodiment, a coating amount per unit area of the developer on the surface of the developing sleeve 28 is regulated at 30 $mg/cm^2$ by the regulating blade 29. Incidentally, the gap between the regulating blade 29 and the developing sleeve 28 is set appropriately in the range of 200-1000 μm, preferably, 300-700 μm. In this embodiment, the gap between the regulating blade 29 and the developing sleeve 28 was set at 400 μm.

<Two-Component Developer>

Next, the two-component developer, which comprises the toner and the magnetic particles (carrier), used in this embodiment will be described. The toner contains primarily a binder resin, and a coloring agent, and as desired, particles of coloring resin, inclusive of other additives, and coloring particles having external additive such as fine particles of choroidal silica, are externally added to the toner. The toner is negatively chargeable polyester-based resin and is desired to be not less than 4 μm and not more than 10 μm, preferably not more than 8 μm, in volume-average particle size.

Further, as the magnetic particles (carrier), particles of metals, the surfaces of which have been oxidized or have not been oxidized, such as iron, nickel, cobalt, manganese, chrome, rare-earth metals, alloys of these metals, and oxide ferrite are preferably usable. The method of producing these magnetic particles is not particularly limited. A weight-average particle size of the magnetic particles (carrier) may be 20 μm-60 μm, preferably, 30 μm-50 μm, and the carrier may be not less than $1\times10^7$ ohm·cm, preferably, not less than $1\times10^8$ ohm·cm, in resistivity. In this embodiment, the magnetic particles (carrier) with a resistivity of $1\times10^8$ ohm·cm were used.

<Supplying Method of Developer>

Next, a developer supplying method in this embodiment will be described using FIG. 2 and FIG. 3. As shown in FIG. 2 and FIG. 3, above the developing device 4, a hopper 31 as a supplying container for accommodating a two-component developer, for supply, containing the toner and the magnetic particles (carrier) in mixture is provided. The hopper 31 constituting a toner supplying means includes a screw-shaped supplying screw 32 as a feeding member at a lower portion thereof, and one end of the supplying screw 32 extends to a position of a developer supply opening 30 provided at a right-hand end portion of the developing device 4 in FIG. 3.

The toner in an amount corresponding to the amount of the toner consumed by image formation is supplied from the hopper 31 to the developing container 22 the developer supply opening 30 by a rotational force of the supplying screw 32 and gravitation of the developer. Thus, from the hopper 31, the supply developer is supplied to the developing device 4. A supply amount of the supply developer is roughly determined by the rotational frequency (number of rotation) of the supplying screw 32. The rotational frequency of the supplying screw 32 is determined by the controller 20 also functioning as a toner supply amount controlling means for controlling a motor 9 as a driving source for rotationally driving the supplying screw 32.

As a toner supply amount controlling method, various methods such as a method of optically or magnetically detect a toner content (density) of the two-component developer and a method of detecting a density of a toner image obtained by developing a reference latent image on the surface of the photosensitive drum 1 are applicable.

<Discharging Method of Developer>

Next, a developer discharging method in this embodiment will be described using FIG. 3. The discharge opening 40 constituting a developer discharging means is provided outside a sleeve placing region of the developing sleeve 28 in a side downstream of the developing chamber 23 with respect to a developer circulation direction shown as arrow direction in FIG. 3, and the deteriorated developer is discharged through the discharge opening 40. When the amount of the developer in the developing device 4 is increased in a developer supplying step, depending on an increase amount of the developer, the developer is discharged through the discharge opening 40 in an overflow manner. Incidentally, a position of the discharge opening 40 is in a side upstream of a position of the developer supply opening 30 with respect to the developer feeding direction shown as the arrow directions in FIG. 3. This is because a fresh (new) developer supplied from the supply opening 30 is prevented from being discharged immediately through the discharge opening 40.

[Discharging Characteristic of Developer>

Figure 4:
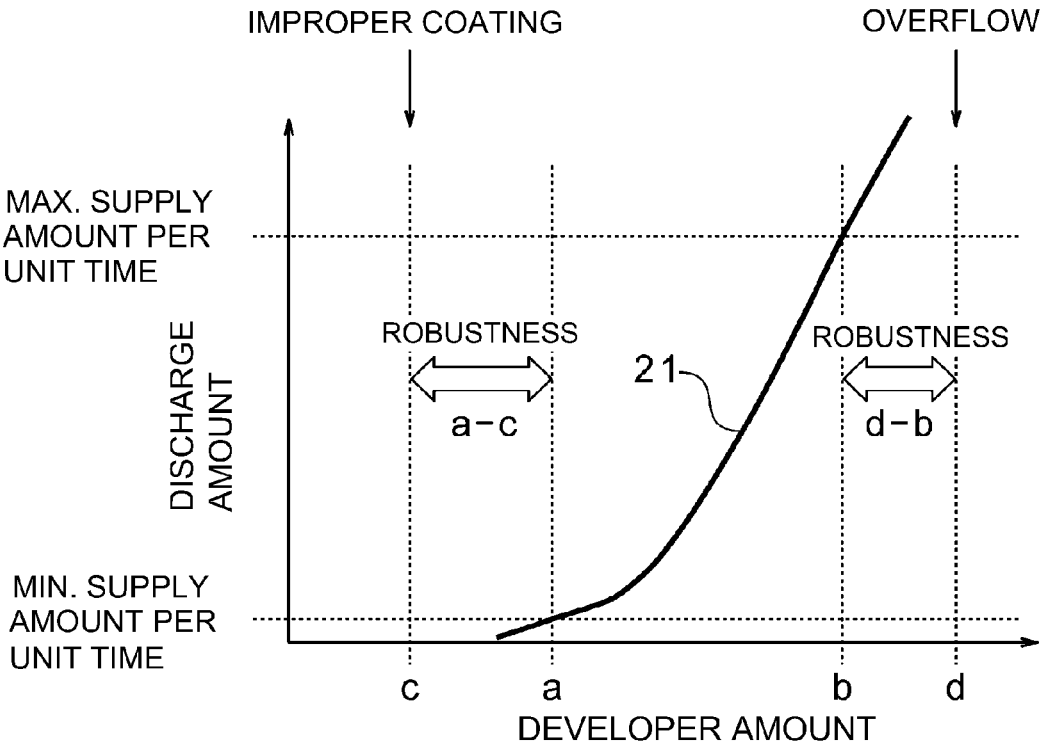
FIG. 4 is a diagram showing a discharging characteristic of a developer discharged through a discharge opening.

FIG. 4 shows a developer discharging characteristic in the developing device 4 in this embodiment. The developer discharging characteristic is a characteristic represented as a function of a developer discharge amount per unit time which is a developer amount in the developing container 22. The developer amount in the developing container 22 is determined by achieving a balance blade the developer discharge amount per unit time and a difference blade a developer supply amount per unit time of the developer supplied into the developing container 22 and an amount of the toner subjected to development (of the latent image).

That is, as regards the developer amount in the developing container 22, a minimum developer amount shown by an intersection point between a minimum supply amount per unit time and a discharging characteristic curve 21 shown in FIG. 4 is taken into consideration. Further, a developer amount b shown by an intersection point between a maximum supply amount per unit time and the discharging characteristic curve 21 is taken into consideration. Further, the developer amount in the developing container 22 roughly exhibits a developer amount value between the minimum developer amount a and the developer amount b. These intersection points are points where the developer amounts are balanced during minimum supply and during maximum supply, respectively. At this time, the amount of the toner subjected to the development (of the latent image) is slight in general, and therefore was neglected.

When the developer amount in the developing container 22 remarkably becomes small, there is a possibility that improper coating of the developer carried on the surface of the developing sleeve 28 generates, and when the developer amount in the developing container 22 remarkably becomes large, there is a possibility that developer overflow is caused. The developer amounts at this time are developer amounts c, d, respectively, shown in FIG. 4.

Then, the discharging characteristic of the developer always has to be such that a relation among developer amounts a, b, c, d is {a>c} and {b<d} as shown in FIG. 4. {a−c} and {d−c} which are differences of these developer amounts represent robustness (robustness in control) against the improper coating of the developer carried on the surface of the developing sleeve 28 and the developer overflow, respectively. The robustness is power by which the characteristics can maintain current states against uncertain fluctuations.

<Discharge Characteristic Measurement of Developer>

Usually, the discharging characteristic of the developer can be measured in the following manner. First, the developer is added into the developing container 22 until the developer is uniformly carried (coated) on the surface of the developing sleeve 28 in a state in which the developing sleeve 28 and the first and second surfaces 25, 26 are rotationally driven at desired peripheral speeds. Then, the developing sleeve 28 and the first and second stirring screws 25, 26 are rotationally driven at the peripheral speeds until circulation of the developer is in a steady state (stable state) in the developing container 22. Usually, these members are rotationally driven for about 1 minute-2 minutes.

From the time when the coating of the developer on the surface of the developing sleeve 28 is uniform, the developer is added gradually into the developing container 22 through the supply opening 30, a developer amount per unit time of the developer discharged through the discharge opening 40 at that time is measured.

In this embodiment, the developer was added into the developing container 22 by 10 g, and the developer amount of the developer discharged through the discharge opening 40 for 30 sec was measured. By this, the developer amount per unit time of the developer discharged through the discharge opening 40 was measured.

Further, the developer amount c as a limit (point) at which improper coating of the developer carried on the surface of the developing sleeve 28 can be measured in the following manner. First, the developing sleeve 28 and the first and second stirring screws 25, 26 are rotationally driven at desired peripheral speeds. In that state, the developer is gradually added into the developing container 22 through the supply opening 30, and the developer amount c in which the developer is uniformly coated on the surface of the developing sleeve 28 is obtained.

Usually, the developer existing in the hopper 31 and the developer existing in the developing container 22 are different in ratio between the toner and the carrier. The developer in the hopper 31 is remarkably higher in toner ratio than the developer in the developing container 22. For that reason, when the developer is added into the developing container 22 in measurement of the discharging characteristic, the hopper 31 is not used. When the developer is supplied from the hopper 31, the toner ratio in the developing container 22 remarkably increases. Usually, when the discharging characteristic is measured, the measurement is made in an idle rotation machine, and the developer with the same toner ratio as the toner ratio in the developing container 22 is manually supplied through the supply opening of the developing container 22.

The above (discharging characteristic) is the discharging characteristic of the developer in the case where both of the developing sleeve 28 and the first stirring screw 25 are driven at predetermined rotational speeds. There are pluralities of rotational speeds of the developing sleeve 28 and the first stirring screw 25. In that case, at these pluralities of rotational speeds, the above-described minimum developer amount a and the developer amount c as the limit (point) at which the improper coating of the developer carried on the surface of the developing sleeve 28 generates have to be uniformized to the possible extent. If not so, there is an increasing possibility that when the rotational speeds of the developing sleeve 28 and the first stirring screw 25 are switched (to different rotational speeds), a problem such as the improper coating or the like of the developer carried on the surface of the developing sleeve 28 generates.

<Operation During Drive Stop>

An operation, as a feature of the present invention, of the developing sleeve 28 and the first and second stirring screws 25, 26 during drive stop will be described. Incidentally, in this embodiment, the first and second stirring screws 25, 26 are interrelated with each other, and therefore description will be made using the first stirring screw 25 as a representative. Accordingly, in the following, in the case where rotation and drive stop are described, also the second stirring screw 26 is rotated and drive-stopped in interrelation with the first stirring screw 25.

Figure 5:
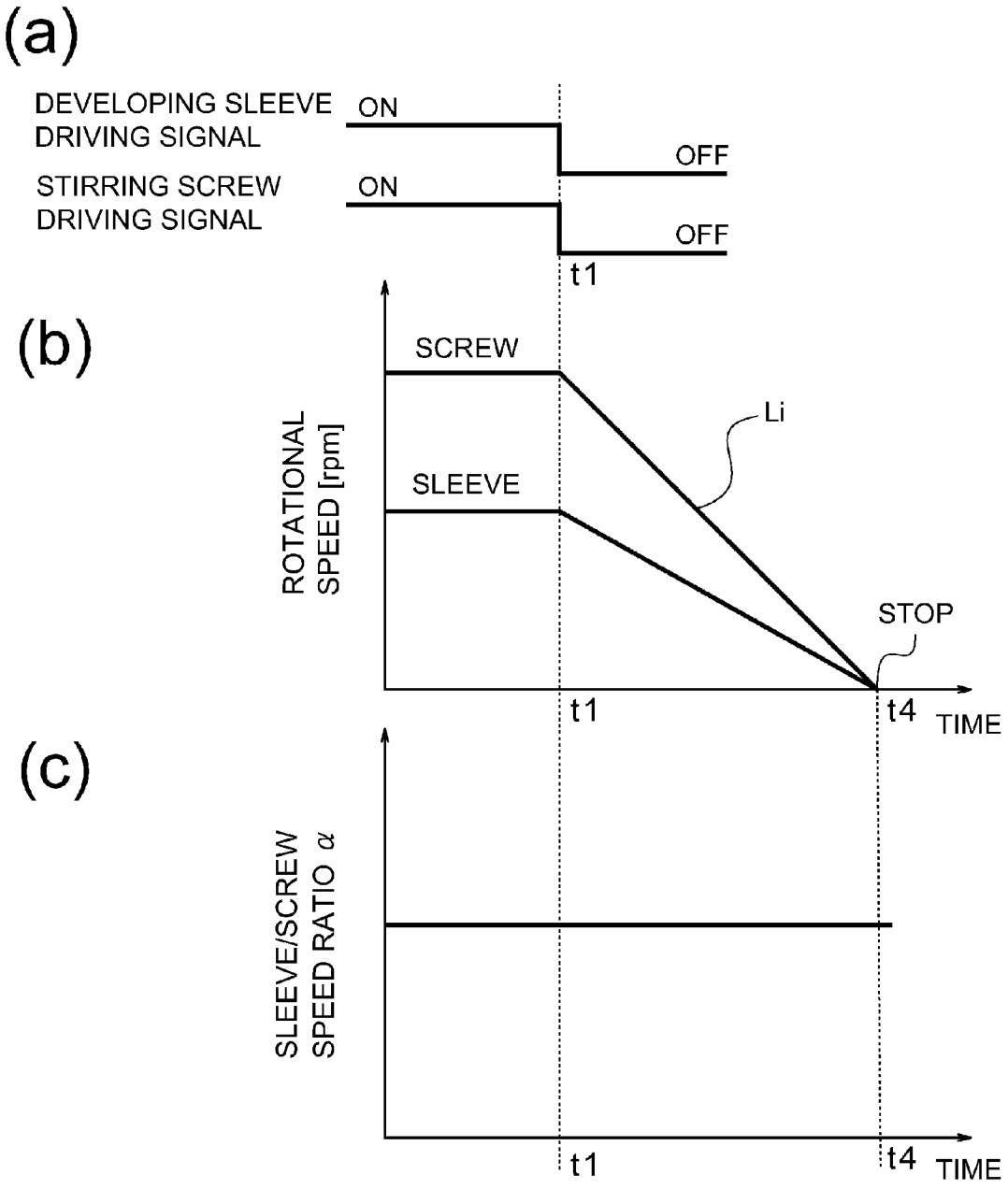
In FIG. 5, (a) is a diagram showing a drive stop signal in a First Embodiment, (b) is a diagram showing a change in rotational speed of a developer carrying member and a stirring member during drive stop in First Embodiment, and (c) is a diagram showing a change in rotational speed ratio between the developer carrying member and the stirring member during drive stop in the First Embodiment.

As shown in (a) of FIG. 5, drive stop signals to the developing sleeve 28 and the first stirring screw 25 generate at a time t1. In FIG. 5, (b) shows a change in rotational speeds of the developing sleeve 28 and the first stirring screw 25 from the time t to a time t4 when the developing sleeve 28 and the first stirring screw 25 completely stop in actuality.

The drive stop signals to the developing sleeve 28 and the first stirring screw 25 are generated by the controller 20, and the motors 7, 8 are stop-controlled. In this embodiment, as the motors 7, 8 shown in FIG. 2, a stepping motor is used. Further, during drive stop of the motors 7, 8, by the controller 20, as shown in (c) of FIG. 5, a ratio $\alpha$ between the rotational speed of the developing sleeve 28 and the rotational speed of the first stirring screw 25 is kept within a predetermined range (in this embodiment, the ratio $\alpha$ is constant). Further, a feature of this embodiment is that the developing sleeve 28 and the first stirring screw 25 are decelerated and stopped.

In this embodiment, as shown in (c) of FIG. 5, at the time t1, the drive stop signals of the developing sleeve 28 and the first stirring screw 25 are outputted to the motors 7, 8 by the controller 20. The rotations of the developing sleeve 28 and the first stirring screw 25 from the time t1 are stopped at the time t4 in actuality. Further, the rotational speed ratio $\alpha$ between the developing sleeve 28 and the first stirring screw 25 in a period including the steady state and from the time t1 to the time t4 is made constant. Here, during drive stop refers to a period from start of deceleration of the motors 7, 8 with intention of stop until the motors 7, 8 stop in actuality, and the drive stop signal refers to a signal for causing the motors 7, 8 to stop with the intention of stop.

Figure 6:
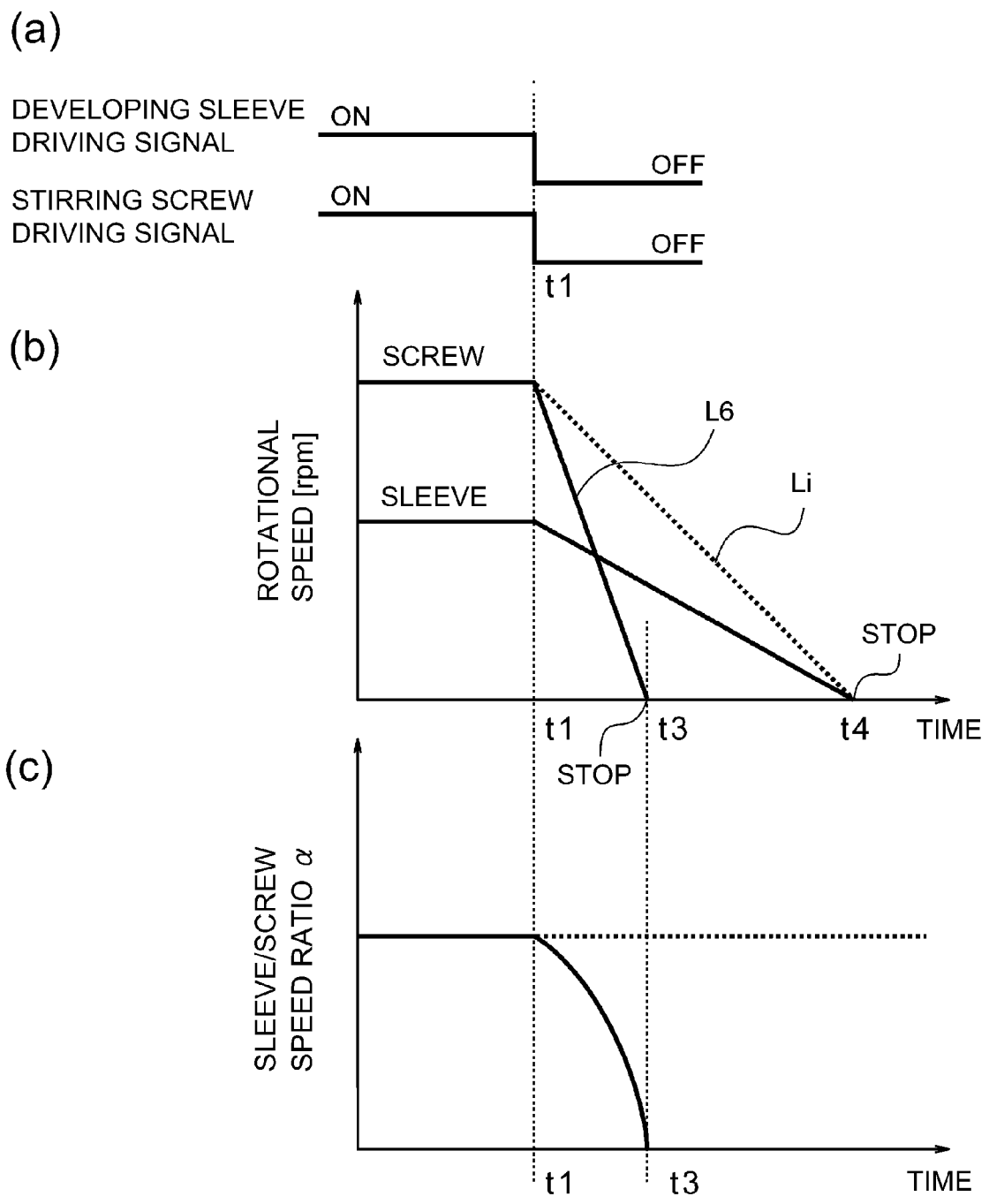
In FIG. 6, (a) is a diagram showing a drive stop signal in Comparison Example 1, (b) is a diagram showing a change in rotational speed of a developer carrying member and a stirring member during drive stop in Comparison Example 1, and (c) is a diagram showing a change in rotational speed ratio between the developer carrying member and the stirring member during drive stop in Comparison Example 1.

On the other hand, as shown in (a) of FIG. 6, at a time t1, the drive stop signals of the developing sleeve 28 and the first stirring screw 25 outputted from the controller 20 are received by the motors 7, 8. Further, as shown in (b) of FIG. 6, the rotational speed ratio $\alpha$ between the developing sleeve 28 and the first stirring screw 25 from the time t1 to times t4, t3 when rotations of the developing sleeve 28 and the first stirring screw 25 stop, respectively, in actuality is not constant (see, (c) of FIG. 6).

This is because conventionally, a DC (direct current) motor is used as the motors 7, 8 in many cases, and an acceleration/deceleration rate cannot be set during drive stop in many cases. Here, the acceleration/deceleration rate is a gradient of the rotational speed from the steady state until the motors 7, 8 receive the drive stop signals and completely stop.

Further, as regards moment of inertia, compared with the developing sleeve 28, the first and second stirring screws 25, 26 are small. For this reason, in Comparison Example 1 shown in FIG. 6, as shown in (a) of FIG. 6, at the time t1, the drive stop signals of the developing sleeve 28 and the first stirring screw 25 are outputted. Further, a time from the time t1 to the times t4, t3 when the developing sleeve 28 and the first stirring screw 25 actually state are, as shown in (b)

of FIG. 6, such that the time t4 when the developing sleeve 28 stops is later than the time t3 when the first stirring screw 25 stops in general.

This means that during drive stop of the developing sleeve 28 and the first stirring screw 25, due to a difference in moment of inertia therebetween, the developing sleeve 28 rotates more (longer) than the first stirring screw 25. Correspondingly to that, the developer existing in a back side (upstream side with respect to the rotational direction of the developing sleeve 28) of the regulating blade 29 opposing the developing sleeve 28 shown in FIG. 2 is taken by the developing sleeve 28 in a state in which the developer is not supplied by the first stirring screw 25. For this reason, the amount of the developer existing in the back side (upstream side with respect to the rotational direction of the developing sleeve 28) of the regulating blade 29 is smaller during drive stop than the time when the developer is in a steady rotation state.

For this reason, during drive stop of the developing sleeve 28 and the first stirring screw 25, the amount of the developer existing in the back side of the regulating blade 29 opposing the developing sleeve 28 becomes small (or completely loses). Then, principally, at the time of start of drive of the developing sleeve 28 and the first stirring screw 25 immediately after the drive stop, a possibility that the improper coating of the developer carried on the surface of the developing sleeve 28 generates temporarily increases.

Figure 7:
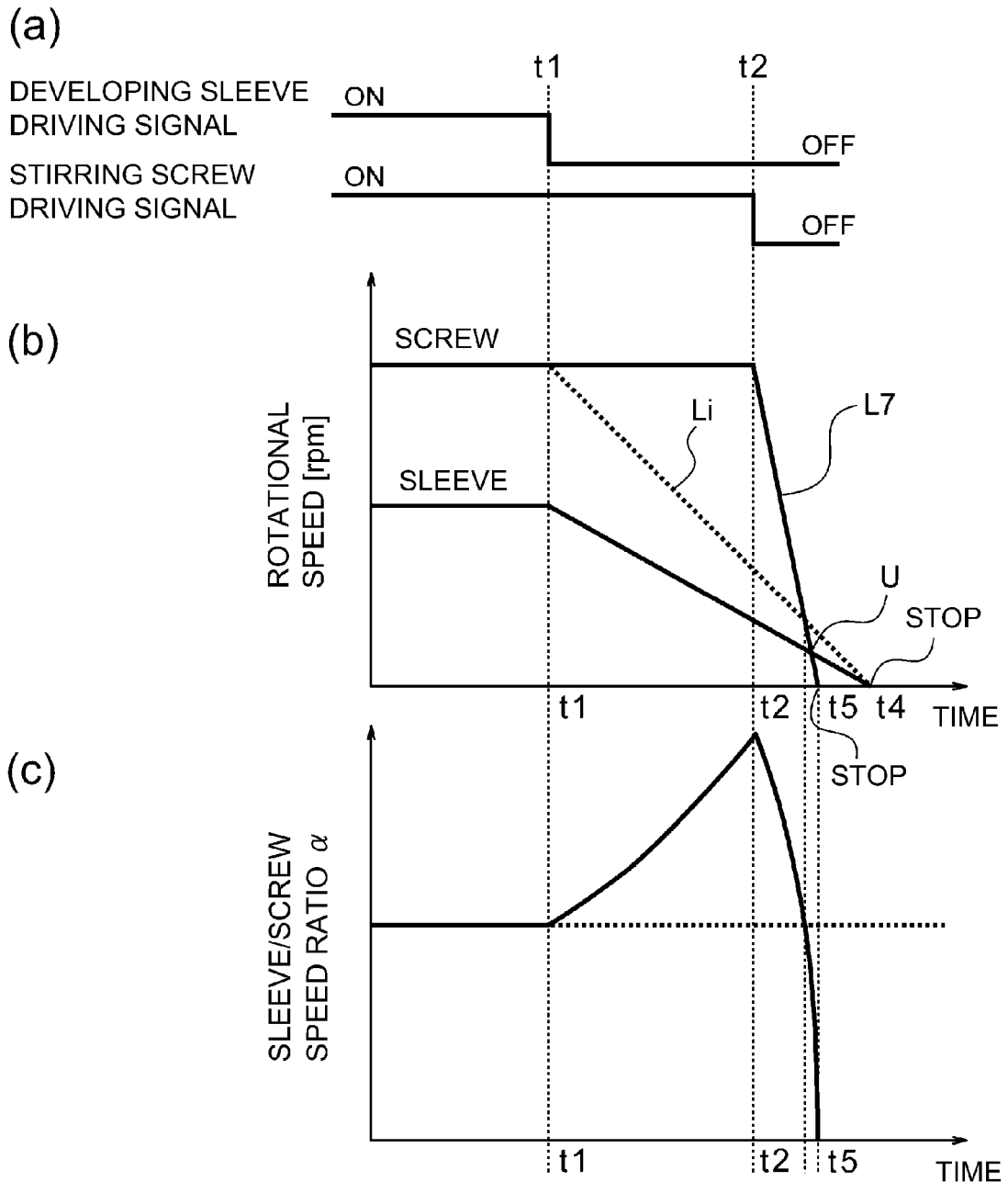
In FIG. 7, (a) is a diagram showing a drive stop signal in Comparison Example 2, (b) is a diagram showing a change in rotational speed of a developer carrying member and a stirring member during drive stop in Comparison Example 2, and (c) is a diagram showing a change in rotational speed ratio between the developer carrying member and the stirring member during drive stop in Comparison Example 2.

As a countermeasure against this, as described above, a drive stop method as in Comparison Example 2 shown in FIG. 7 would be considered. In Comparison Example 2 shown in FIG. 7, as shown in (a) of FIG. 7, a time t2 when the drive stop signal of the first stirring screw 25 is outputted is intentionally made late. The developing sleeve 28 stops at a time t4, and the first stirring screw 25 stops at a time t5 (t4>t5). By this supply of the developer to the developing sleeve 28 during drive stop of the developing sleeve 28 and the first stirring screw 25 is made abundant, so that the improper coating of the developer carried on the surface of the developing sleeve 28 is suppressed.

However, in the drive stop method as in Comparison Example 2 shown in FIG. 7, the first and second stirring screws 25, 26 continuously rotate excessively until the developing sleeve 28 stops in actuality, so that also the developer which should not be originally discharged through the discharge opening 40 shown in FIG. 3 is excessively discharged. By this, lowering in developer amount in the developing device 4 is invited. Or, the increase in driving time of the first and second stirring screws 25, 26 causes deterioration of the developer and deterioration of seal at end portions of the rotation shafts 25*a*, 26*a* of the first and second stirring screws 25, 26. By this, there is a possibility that the driving time increase leads to a lowering in lifetime of the developing device 4.

In the developing device 4 in this embodiment, as shown in FIG. 2, the developing chamber 23 from which the developer is supplied to the developing sleeve 28 and the stirring chamber 24 into which the developer is collected are separated. In the developing chamber 23 from which the developer is supplied, the developer is taken by the developing sleeve 28 with a decreasing distance toward a downstream side with respect to a developer circulation direction. For this reason, an amount of the developer fed by the first stirring screw 25 per unit time, i.e., an amount of flow (mass flow rate)) of the developer gradually decreases.

On the other hand, in the stirring chamber 24 into which the developer is collected, the amount of flow of the developer increases with the decreasing distance toward the downstream side with respect to the developer circulation direction. Further, the discharge opening 40 shown in FIG. 3 is provided at a most downstream portion of the developing chamber 23 with respect to the developer circulation direction. The developer surface (upper surface of the developer) at this portion reaches a height of the discharge opening 40, and when the developer surface further exceeds the height of the discharge opening 40, the developer overflows the discharge opening 40 and is discharged to an outside of the developing container 22.

In the developing device 4 in this embodiment, a developer surface height h2 in the developing chamber 23 in the neighborhood of the discharge opening 40 depends on the developer amount in the developing device 4. Further, the developer surface height h2 also depends on a feeding amount of the first stirring screw 25 with respect to a longitudinal direction and an amount of the developer taken from the inside of the stirring chamber 24 to the developing sleeve 28, i.e., a developer feeding amount of the developing sleeve 28.

Figure 8:
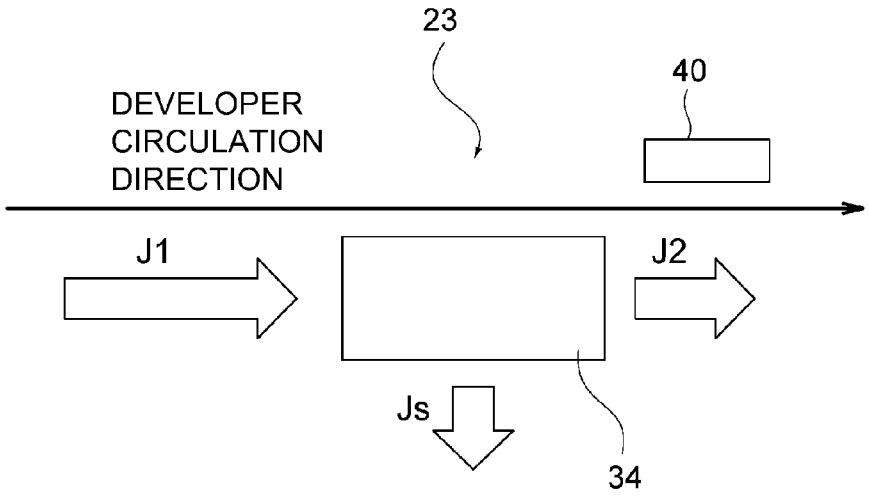
In FIG. 8, (a) and (b) are diagrams for illustrating an amount of flow of the developer in the neighborhood of the discharge opening.
Figure 8:
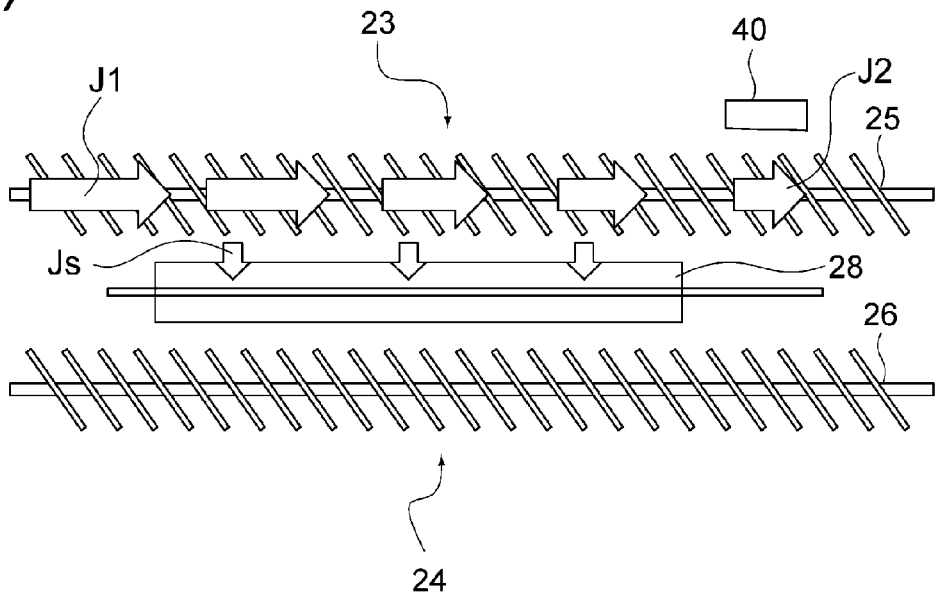

In FIG. 8, (a) and (b) are schematic views showing the amount of flow of the developer in the developing chamber 23 shown in FIG. 3, and magnitudes of arrows shown by arrows J1, J2, Js shown in (a) and (b) of FIG. 8 represent magnitudes of the amounts of flow of the developer. The amount of flow of the developer in a place where the developing sleeve 28 does not oppose the place is simply acquired by the product of a developer amount ρ per unit distance at that position with respect to the longitudinal direction and a developer circulation speed V in the developing chamber 23.

Accordingly, the developer flow amount J2 in the neighborhood of the discharge opening 40 provided in a place where the developing sleeve 28 does not oppose the discharge opening 40 is as follows. The developer flow amount in the developing chamber 23 in a side upstream of a region 34, with respect to the developer circulation direction, which is shown in (a) of FIG. 8 and where the developing sleeve 28 opposes is J1. The developer flow amount by an entirety of the developing sleeve 28 is Js. The developer amount per unit distance with respect to the longitudinal direction in the developing chamber 23 in a side upstream of the region 34, with respect to the developer circulation direction, where the developing sleeve 28 opposes is ρ1. A feeding speed of the developer by the first stirring screw 25 is Va. A developer amount per unit distance with respect to the rotational direction in an entire region of the developing sleeve 28 with respect to the longitudinal direction is m. When a surface movement speed of the developing sleeve 28 is Vs, the developer flow amount J2 is acquired by the following (mathematical) formula 1.

$$J2=\rho 2\times Va=J1-Jp=(\rho 1\times Va)-(m\times Vs) \quad \text{[formula 1]}$$

A depth of the developing chamber 23 is uniform and therefore when the depth is "1" for convenience, the developer amount per unit distance of the developing chamber 23 with respect to the longitudinal direction can be regarded as the developer surface height as it is. For this reason, the developer surface height h2 in the neighborhood of the discharge opening 40 in the developing chamber 23 and the developer amount ρ2 per unit distance in the neighborhood of the discharge opening 40 with respect to the longitudinal direction in the developing chamber 23 during drive stop of the developing sleeve 28 and the first stirring screw 25 are roughly acquired by the following formula 2.

$$h2=\rho 2=(\rho 1\times Va-m\times Vs)/Va=\rho 1-m\times Vs/Va \quad \text{[formula 2]}$$

The surface movement speed Vs of the developing sleeve 28 and the developer feeding speed Va by the first stirring screw 25 are proportional to a rotational speed ω(s) of the developing sleeve 28 and a rotational speed ρ(a) of the first stirring screw 25, respectively. For this reason, {ω(a)/ω(s)} which is a ratio α between the rotational speed ω(s) of the developing sleeve 28 and the rotational speed ω(a) of the first stirring screw 25 may only be required to be constant. By this, even in the case where the developer surface height h2 in the neighborhood of the discharge opening 40 in the developing chamber 23 during drive stop of the developing sleeve 28 and the first stirring screw 25 is unchanged. This holds true similarly for an arbitrary place in the developing chamber 23.

Therefore, the developer surface height h2 in the neighborhood of the discharge opening 40 in the developing chamber 23 during drive stop of the developing sleeve 28 and the first stirring screw 25 is made equal to a developer surface height h in the neighborhood of the discharge opening 40 in the developing chamber 23 in the steady state during image formation. As shown in (c) of FIG. 5, {ω(a)/ω(s)} which is the rotational speed ratio α between the developing sleeve 28 and the first stirring screw 25 in the steady state during image formation is kept constant. Then, the developing sleeve 28 and the first stirring screw 25 may only be required to be decelerated and stopped.

That is, the ratio α(E) between the rotational speed of the developing sleeve 28 and the rotational speed of the first stirring screw 25 during drive stop of the developing sleeve 28 and the first stirring screw 25 may only be required to be decelerated and stopped while being caused to coincide with the ratio α in the steady state during image formation.

In this embodiment shown in (b) of FIG. 5, after the drive stop signals of the developing sleeve 28 and the first stirring screw 25 are outputted, the developing sleeve 28 and the first stirring screw 25 stop in actuality at the time t4. At an arbitrary time from the time t1 to the time t4, the developer surface height h2 in the neighborhood of the discharge opening 40 in the developing chamber 3 in the steady state during image formation is always as follows. The developer surface height h2 is equal to the developer surface height h in the neighborhood of the discharge opening 40 in the developing chamber 23 in the steady state during image formation. By this, it is possible to prevent insufficient developer supply to the developing sleeve 28 and excessive discharge of the developer through the discharge opening 40 during drive stop of the developing sleeve 28 and the first stirring screw 25.

On the other hand, the rotational speed ratio α between the developing sleeve 28 and the first stirring screw 25 is not constant during drive stop in some instances. In that case, also the developer surface height h in the neighborhood of the discharge opening 40 in the developing chamber 23 during drive stop of the developing sleeve 28 and the first stirring screw 25 fluctuates compared with that at the time of the steady state.

For this reason, the amount of the developer existing in the back side of the regulating blade 29 opposing the developing sleeve 28 shown in FIG. 2 becomes small, so that a possibility of generation of the improper coating of the developer carried on the surface of the developing sleeve 28 increases.

For example, in the case of Comparison Example 1 shown in (a) of FIG. 6, the rotational speed ratio α between the developing sleeve 28 and the first stirring screw 25 is not constant. At the time t1, the drive stop signals of the developing sleeve 28 and first stirring screw 25 are outputted. Then, the rotational speed ratio α between the developing sleeve 28 and the first stirring screw 25 is always smaller than that at the time of the steady state. Broken lines shown in (b) and (c) of FIG. 6 show a change in rotational speed of the first stirring screw 25 in the case where the rotational speed ratio α between the developing sleeve 28 and the first stirring screw 25 is equal to that at the time of the steady state as in this embodiment shown in (b) and (c) of FIG. 5.

On the other hand, in the case of Comparison Example 2 shown in (b) of FIG. 7, until a point U shown in (b) of FIG. 7, the rotational speed of the first stirring screw 25 is larger than the rotational speed of the first stirring screw 25 in this embodiment shown in FIG. 5, and becomes smaller from the point U on. Broken lines shown in (b) and (c) of FIG. 7 show a change in rotational speed of the first stirring screw 25 in the case where the rotational speed ratio α between the developing sleeve 28 and the first stirring screw 25 is equal to that at the time of the steady state as in this embodiment shown in (b) and (c) of FIG. 5.

For this reason, as shown in (c) of FIG. 7, after the drive stop signal of the developing sleeve 28 is outputted at the time t1, the rotational speed ratio α between the developing sleeve 28 and the first stirring screw 25 becomes larger than that at the time of the steady state. Thereafter, at the time t2, the drive stop signal of the first stirring screw 25 is outputted and then the rotational speed ratio α between the developing sleeve 28 and the first stirring screw 25 becomes small. By this, during drive stop of the developing sleeve 28 and the first stirring screw 25, until the point U shown in (b) of FIG. 7, the developer surface height h2 in the neighborhood of the discharge opening 40 in the developing chamber 23 rises. By this, the developer is excessively discharged through the discharge opening 40, so that a possibility of the improper coating of the developer carried on the surface of the developing sleeve 28 increases.

<Experimental Result>

Figure 9:
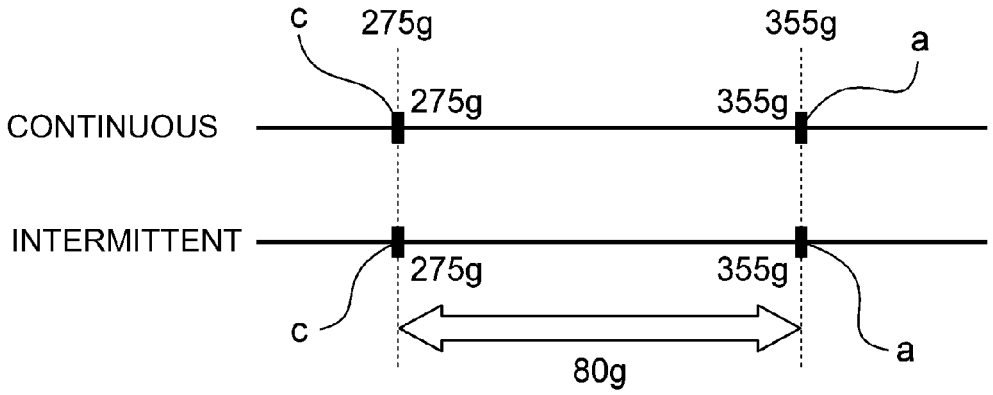
FIG. 9 is a diagram showing disorder of developer circulation during drive stop in the First Embodiment.
Figure 10:
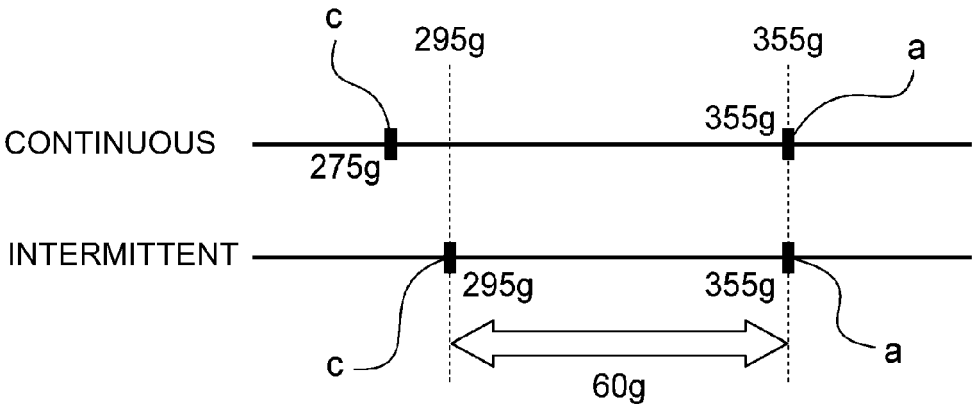
FIG. 10 is a diagram showing disorder of developer circulation during drive stop in Comparison Example 1.
Figure 11:
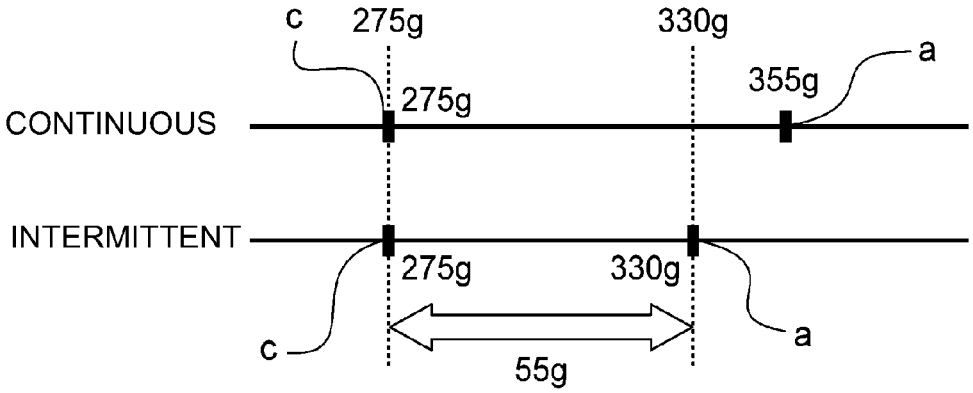
FIG. 11 is a diagram showing disorder of developer circulation during drive stop in Comparison Example 2.

Next, an experimental result of the discharging characteristic of the developer in which an effect of comparison of this embodiment with Comparison Examples 1, 2 is shown will be described using FIG. 9 to FIG. 11. FIG. 9 shows the experimental result of the discharging characteristic of the developer in this embodiment shown in FIG. 5, FIG. 10 shows the experimental result of the discharging characteristic of the developer in Comparison Example 1 shown in FIG. 6, and FIG. 11 shows the experimental result of the discharging characteristic of the developer in Comparison Example 2 shown in FIG. 7. Each of FIG. 9 to FIG. 11 shows a relation between a developer amount c as a limit of generation of the improper coating of the developer carried on the surface of the developing sleeve 28 and a minimum developer amount a as a lower limit of the developer amount which are shown in FIG. 4.

In Comparison Example 1 shown in FIG. 10, the developer amount c as the limit of generation of the improper coating of the developer carried on the surface of the developing sleeve 28 during a continuous operation is 275 g. On the other hand, the developer amount c as the limit of generation of the improper coating of the developer carried on the surface of the developing sleeve 28 during intermittent operation was 295 g. Accordingly, during intermittent operation relative to during continuous operation, the developer amount c as the limit of generation of the improper coating of the developer carried on the surface of the developing sleeve 28 increases by about 20 g (=295 g−275 g) (deterioration of robustness).

That is, in Comparison Example 1 shown in FIG. 10, robustness (robustness in control) against the improper coating of the developer carried on the surface of the developing sleeve 28 is as follows. When also switching between during continuous operation and during intermittent operation is taken into consideration, the robustness is a developer amount of about 60 g corresponding to a change in developer amount as shown by an arrow in FIG. 10. The robustness is power by which the characteristic is capable of maintaining a current status against an uncertain fluctuation.

In Comparison Example 2 shown in FIG. 11, the minimum developer amount a as the lower limit of the developer amount during continuous operation is 355 g. On the other hand, the minimum developer amount a as the lower limit of generation of the developer amount during intermittent operation was 330 g. Accordingly, during intermittent operation relative to during continuous operation, the minimum developer amount a as the lower limit decreases by about 25 g (=355 g−330 g) (deterioration of robustness).

Also in this case, robustness against the improper coating of the developer carried on the surface of the developing sleeve 28 is, when also switching between during continuous operation and during intermittent operation is taken into consideration, a developer amount of about 55 g corresponding to a change in developer amount as shown by an arrow in FIG. 11.

On the other hand, in this embodiment shown in FIG. 9, the developer surface height h2 in the neighborhood of the discharge opening 40 in the developing chamber 23 during drive stop of the developing sleeve 28 and the first stirring screw 25 was as follows. The developer surface height h2 was constituted so as to be equal to the developer surface height h in the neighborhood of the portion 40 in the developing chamber 23 in the steady state during continuous operation.

For this reason, the developer amount c as the limit of generation of the improper coating of the developer carried on the surface of the developing sleeve 28, and the minimum developer amount a as the lower limit of the developer amount are 275 g and 355 g, respectively, are substantially equal during continuous operation and during intermittent operation.

By this, also during the switching between the continuous operation and the intermittent operation, there is no component of deterioration of the robustness against the improper coating of the developer carried on the surface of the developing sleeve 28, so that the robustness is a developer amount of about 80 g corresponding to a change in developer amount as shown by an arrow in FIG. 9. The robustness is better with a larger difference between the developer amount c as the limit of generation of the improper coating of the developer carried on the surface of the developing sleeve 28 and the minimum developer amount a as the lower limit of the developer amount.

In this embodiment, the ratio α(E) between the rotational speed of the developing sleeve 28 and the rotational speed of the first stirring screw 25 during drive stop of the developing sleeve 28 and the first stirring screw 25 may only be required to be decelerated and stopped while being caused to coincide with the ratio α in the steady state during image formation.

By this, the out-of-balance developer circulation in the developing device 4 was suppressed, so that it was able to ensure the robustness against the improper coating of the developer carried on the surface of the developing sleeve 28. Incidentally, as in this embodiment, the rotational speed ratio α between the developing sleeve 28 and the first stirring screw 25 during drive stop of the developing sleeve 28 and the first stirring screw 25 may also be not required to completely coincide with the ratio α during image formation.

For example, of the drive stop signal (stop signal) of the motor 7 from the controller 20 and the drive stop signal (stop signal) of the motor 8 from the controller 20, either earlier one is outputted. Then, each of the rotational speeds of both of the developing sleeve 28 and the first stirring screw 25 becomes ½ or less of the rotational speed in the steady state during image formation.

In a period until then, each of the rotational speeds of both of the developing sleeve 28 and the first stirring screw 25 is not more than the rotational speed in the steady state during image formation. And, the ratio α(E) between the rotational speed of the developing sleeve 28 and the rotational speed of the first stirring screw 25 is as follows. The ratio α(E) may only be required to satisfy the following formula 3 relative to the ratio α between the rotational speed of the developing sleeve 28 and the rotational speed of the first stirring screw 25 in the steady state during image formation.

$$0.7<\alpha(E)/\alpha<2.0, \qquad \text{[formula 3]}$$

where the ratio α(E) is ωa(E)/ωs(E) wherein ωs(E) is the rotational speed of the developing sleeve 28 is and ωa(E) is the rotational speed of the first stirring screw 25, and further where the ratio α if ωa/ωs wherein ωs is the rotational speed of the developing sleeve 28 in the steady state during the image formation and ωa is the rotational speed of the first stirring screw 25 in the steady state during the image formation.

That is, when the rotational speed ratio α between the developing sleeve 28 and the first stirring screw 25 during drive stop of the developing sleeve 28 and the first stirring screw 25 is not less than 0.7 time and less than 2.0 times the ratio α during image formation, a similar effect is obtained.

In this embodiment, in the developing device 4 in which the developing sleeve 28 and the first stirring screw 25 are separately driven, either earlier one of the drive stop signals of the developing sleeve 28 and the first stirring screw 25 is outputted. Then, each of the rotational speeds of both of the developing sleeve 28 and the first stirring screw 25 becomes ½ or less of the rotational speed in the steady state during image formation.

In a period until then, each of the rotational speeds of both of the developing sleeve 28 and the first stirring screw 25 is not more than the rotational speed in the steady state during image formation. And, the ratio α(E) between the rotational speed of the developing sleeve 28 and the rotational speed of the first stirring screw 25 during drive stop is as follows. The ratio α(E) satisfies the above-described formula 3 relative to the ratio α between the rotational speed of the developing sleeve 28 and the rotational speed of the first stirring screw 25 in the steady state during image formation.

By this, the rotational speed ratio α(E) between the developing sleeve 28 and the first stirring screw 25 during drive stop is brought near to the rotational speed ratio α during image formation. By this, the out-of-balance developer circulation is suppressed, so that it is possible to prevent image defect such as the improper coating of the developer carried on the developing sleeve 28.

In a further preferable example, it is also possible to use a rotational frequency ratio β(E) between the developing sleeve 28 and the first stirring screw 25 during drive stop and a rotational frequency ratio β between the developing sleeve 28 and the first stirring screw 25 in the steady state during image formation. For example, of the drive stop signal (stop signal) of the motor 7 from the controller 20 and the drive stop signal (stop signal) of the motor 8 from the controller 20, either earlier one is outputted. Then, until both of the developing sleeve 28 and the first stirring screw 25 stop, the rotational frequency β(E) between the rotational frequency of the developing sleeve 28 and the rotational frequency of the first stirring screw 25 is as follows. The rotational frequency β(E) may also be set to satisfy the following formula 4 relative to the rotational frequency β between the rotational frequency of the developing sleeve 28 and the rotational frequency of the first stirring screw 25 in the steady state during image formation. Incidentally, the ratio β between the rotational frequency of the developing sleeve 28 and the rotational frequency of the first stirring screw 25 in the steady state during image formation refers to a ratio between the rotational frequency per unit time of the developing sleeve 28 and the rotational frequency per unit time of the first stirring screw 25 in the steady state during image formation.

$$0.7<\beta(E)/\beta<1.5, \quad \text{[formula 4]}$$

where the ratio β(E) is Ra(E)/Rs(E) wherein Rs(E) is the rotational frequency of the developing sleeve 28 is and Ra(E) is the rotational frequency of the first stirring screw 25, and further where the ratio β if Ra/Rs wherein Rs is the rotational frequency of the developing sleeve 28 in the steady state during the image formation and Ra is the rotational speed of the first stirring screw 25 in the steady state during the image formation.

That is, when the rotational frequency ratio β(E) between the developing sleeve 28 and the first stirring screw 25 during drive stop of the developing sleeve 28 and the first stirring screw 25 is not less than 0.7 time and less than 2.0 times the ratio β during image formation, a similar effect is obtained. Incidentally, numerical ranges shown in the formula 3 and the formula 4 will be described in detail using the Second Embodiment below.

According to this embodiment, in the developing device 4 in which the developing sleeve 28 and the first stirring screw 25 are separately driven, it is possible to suppress the out-of-balance developer circulation. Further, it is possible to prevent the improper coating or the like when the developer is coated on the surface of the developing sleeve 28.

Embodiment 2

Next, a constitution of Second Embodiment of the image forming apparatus including the developing device according to the present invention will be described using FIG. 12 to FIG. 22. Incidentally, members constituted similarly as in the First Embodiment described above will be omitted from description by adding the same symbols or the same member names even when symbols are different.

A basic constitution is the same as that in the First Embodiment described above, and therefore redundant description will be omitted, and only a constitution peculiar to this embodiment will be specifically described. In the above-described First Embodiment, as shown in FIG. 2, the stepping motor was used as the motors 7, 8 as the driving sources for rotationally driving the first and second stirring screws 25, 26.

By this, as shown in (b) and (c) of FIG. 5, the ratio α(E) between the rotational speed of the developing sleeve 28 and the rotational speed of the first stirring screw 25 during drive stop of the developing sleeve 28 and the first stop 25 is as follows. The ratio α(E) may only be required to be decelerated and stopped while being caused to coincide with the ratio α in the steady state during image formation. By this, the out-of-balance developer circulation was suppressed, so that the robustness against the improper coating of the developer carried on the surface of the developing sleeve 28 was ensured.

<Operation During Drive Stop>

However, from the viewpoints of efficiency, drive stability, and in addition, a cost and the like, as the driving sources of the developing sleeve 28 and the first and second stirring screws 25, 26, it is preferable that the DC (direct current) motor is used. In this embodiment, as the driving sources of the developing sleeve 28 and the first and second stirring screws 25, 26, a brush-less DC (direct current) motor was used.

Further, as shown in (b) of FIG. 2, during drive stop of the developing sleeve 28 and the first and second developing sleeves 25, 26, at least one of the during drive stops (stop signals) of the motors 7, 8 are outputted from the controller 20. Then, at least one of target rotational speeds of the developing sleeve 28 and the first and second stirring screws 25, 26 is changed stepwisely.

Figure 12:
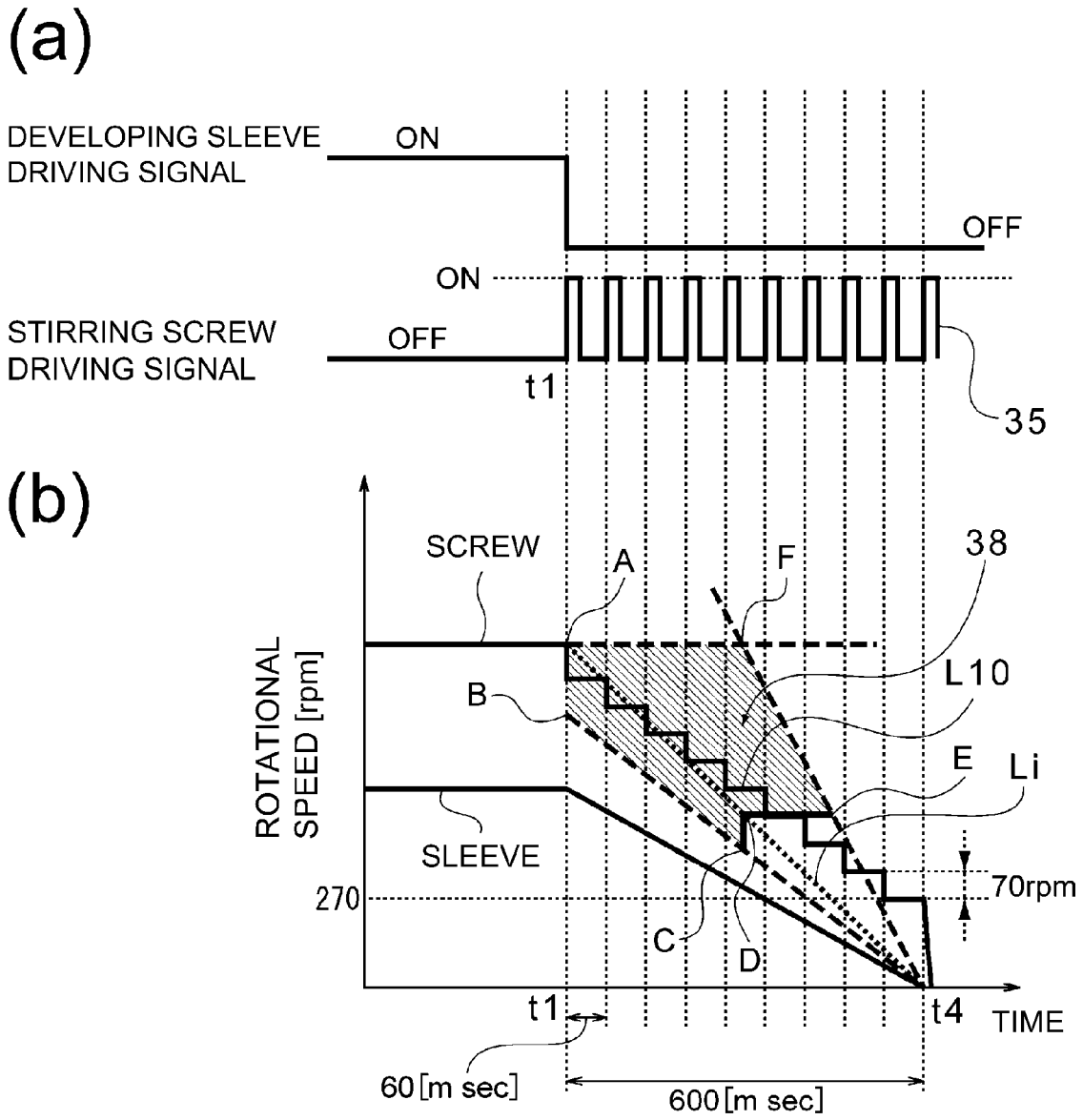
In FIG. 12, (a) is a diagram showing a drive stop signal in a Second Embodiment, and (b) is a diagram showing a change in rotational speed of a developer carrying member and a stirring member during drive stop in the Second Embodiment.

This embodiment shown in (b) of FIG. 12 is an embodiment in which the target rotational speed of the first and second stirring screws 25, 26 is stepwisely changed (decelerated). As shown in (b) of FIG. 12, the developing sleeve 28 and the first and second stirring screws 25, 26 are stepwisely decelerated and stopped. By this, the out-of-balance developer circulation is alleviated and the robustness against the improper coating of the developer carried on the surface of the developing sleeve 28 is ensured. This is a feature of this embodiment.

In FIG. 12, (a) shows the drive stop signals of the developing sleeve 28 and the first stirring screw 25 in this embodiment. In FIG. 12, (b) shows a change in rotational speed of the developing sleeve 28 and the first stirring screw 25 during drive stop of the developing sleeve 28 and the first stirring screw 25.

As shown in (b) of FIG. 12, during drive stop of the developing sleeve 28 and the first stirring screw 25, the rotational speed of the first stirring screw 25 is stepwisely decelerated. By this, the rotational speed ratio α between the developing sleeve 28 and the first stirring screw 25 during drive stop of the developing sleeve 28 and the first stirring screw 25 is substantially equal to the ratio α in the steady state during continuous operation. By this, the out-of-balance developer circulation is suppressed.

In this embodiment, as shown in (b) of FIG. 12, from the time t1 of generation of the drive stop signals of the developing sleeve 28 and the first stirring screw 25, every 60 msec, the rotational speed of the first stirring screw 25 is changed at 10 stages (levels). By this, the first stirring screw 25 is stepwisely decelerated and stopped. One change width of the rotational speed of the first stirring screw 25 is 270 rpm only at the final stage, and is 70 rpm at each of other stages. This is because in the case where the DC (direct current) motor is driven at a low speed, there is a possibility that the drive stability lowers.

Originally, during drive stop of the developing sleeve 28 and the first stirring screw 25, the balance of the developer circulation is made equal to the developer circulation in the steady state. For that purpose, as in the above-described First Embodiment, at all of the times until drive of the developing sleeve 28 and the first stirring screw stops, the following is required. The rotational speed ratio α between the developing sleeve 28 and the first stirring screw 25 may only be required to be made equal to the ratio α in the steady state.

Figure 13:
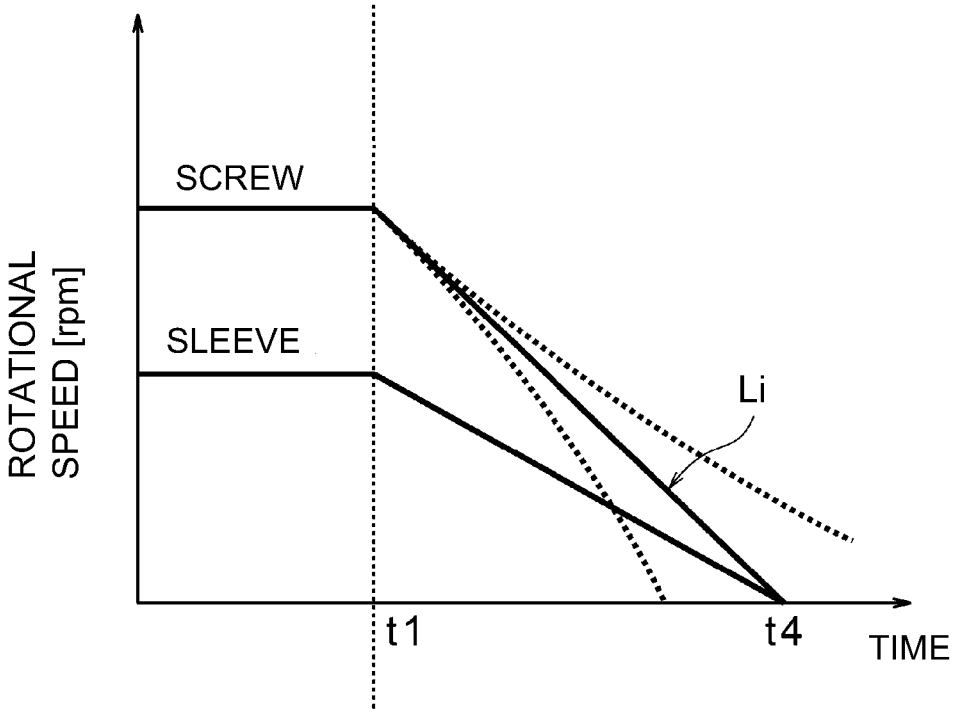
FIG. 13 is a diagram for illustrating that even when a change in rotational speed deviates from an ideal line, there is no problem if the deviation is some deviation.

However, in actuality, the developer circulation is not out of balance even when the rotational speed somewhat deviates from an ideal line Li shown by a solid line in FIG. 13. On the other hand, in the case where the DC (direct current) motor is used as the driving sources of the developing sleeve 28 and the first stirring screw 25, different from the stepping motor, the angular acceleration cannot be set.

For this reason, in order to suppress the out-of-balance developer circulation during drive stop of the developing sleeve 28 and the first stop 25, the following is required. As in this embodiment shown in (a) of FIG. 12, the drive stop signals of the developing sleeve 28 and the first stirring screw 25 are generated at the time t1. From the time t1 until the time t4 when the developing sleeve 28 and the first stirring screw 25 stop in actuality, a plurality of driving speed change signals 35 consisting of pulse waves for the first stirring screw 25 are outputted. By this, as shown in (b) of FIG. 12, the first stirring screw 25 can be stepwisely decelerated and stopped.

At this time, a point deviated from the ideal line Li (ideal line Li in First Embodiment shown in (b) of FIG. 5) shown by a broken line passing through points A, D shown in (b) of FIG. 12 generates. In this embodiment, the point deviated from the ideal line Li shown by the broken line passing through the points A, D shown in 8*b*) of FIG. 12 is suppressed within a range in which the developer circulation is not out of balance. By this, the out-of-balance developer circulation during drive stop of the developing sleeve 28 and the first stirring screw 25 was suppressed while using the DC (direct current) motor excellent in cost and drive stability.

In this embodiment, the rotational speed ratio between the developing sleeve 28 and the first stirring screw 25 during drive stop is $\alpha(E)$. The ratio $\alpha(E)$ is differentiated from the rotational speed ratio $\alpha$ between the developing sleeve 28 and the first stirring screw 25 in the steady state. Further, the deviation from the ideal line Li shown in (b) of FIG. 12 during drive stop of the developing sleeve 28 and the first stirring screw 25 is represented by using $\{\alpha(E)/\alpha\}$. In the above-described First Embodiment, during drive stop of the developing sleeve 28 and the first stirring screw 25, $\{\alpha(E)/\alpha\}$ is always "1.0".

According to considerable investigation by the present inventors, a condition in which the developer circulation is not largely out of balance and the developer surface height h2 in the neighborhood of the discharge opening 40 in the developing chamber 23 during drive stop of the developing sleeve 28 and the first stirring screw 25 was as follows. Of the drive stop signals of the motor 7 and of the motor 8, either earlier one is outputted. Then, each of the rotational speeds of both of the developing sleeve 28 and the first stirring screw 25 becomes ½ or less of the rotational speed in the steady state during image formation. In a period until then, the rotational speeds of both of the developing sleeve 28 and the first stirring screw 25 are as follows. In turned out that the rotational speeds may only be required to be not more than the rotational speeds, respectively, in the steady state during image formation and to satisfy the condition shown by the above-described formula 3.

Here, the reason why "in the period until the rotational speeds of both of the developing sleeve 28 and the first stirring screw 25 are ½ or less of the rotational speeds, respectively, in the steady state during image formation" is as follows. The developer circulation is out of balance, so that the amount of the developer existing in the back side of the regulating blade 29 opposing the developing sleeve 28 shown in FIG. 2 decreases, and the developer leaks out of the discharge opening 40 shown in FIG. 3. Such a phenomenon is conspicuous when the rotational speeds of the developing sleeve 28 and the first stirring screw 25 are large.

The rotational speeds of the developing sleeve 28 and the first stirring screw 25 are small. At this time, even when the ratio $\{\alpha(E)/\alpha\}$ between the rotational speed ratio $\alpha$ between the developing sleeve 28 and the first stirring screw 25 in the steady state and the rotational speed ratio $\alpha(E)$ between the developing sleeve 28 and the first stirring screw 25 during drive stop deviates from the range of the above-described formula 3, there is almost no problem.

Further, needless to say, a most ideal case is the case where as in the above-described First Embodiment, during drive stop of the developing sleeve 28 and the first stirring screw 25, $\{\alpha(E)/\alpha=1.0\}$ holds. That is, the most ideal case is the case where the rotational speeds of the developing sleeve 28 and the first stirring screw 25 always linearly decelerate at the same ratio $\alpha$ as the rotational speed ratio $\alpha$ in the steady state during image formation as shown in (b) and (c) of FIG. 5.

Figure 14:
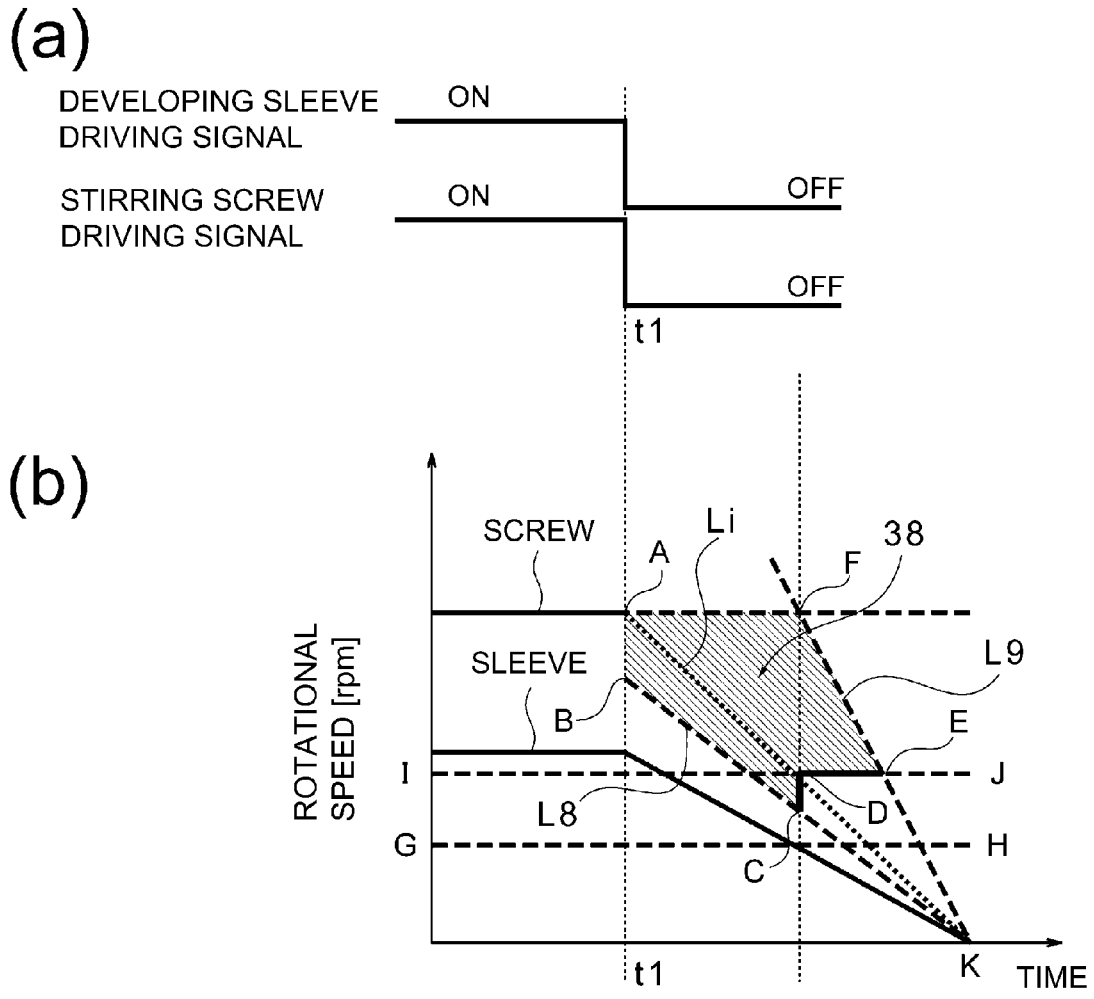
In FIG. 14, (a) is a diagram showing a drive stop signal, and (b) is a diagram for illustrating a change in rotational speed of the stirring member by using regions ABCDEF.

Description will be made specifically using (a) and (b) of FIG. 14. An ideal line Li shown by a broken line connecting points A, K is as follows. As shown in FIG. 14, a change in rotational speed of the first stirring screw 25 in the above-described First Embodiment shown in (b) and (c) of FIG. 5 in which $\{\alpha(E)/\alpha=1.0\}$ when the developing sleeve 28 is driven and stopped holds is shown.

A line L8 shown by a broken line connecting points B, K shown in (b) of FIG. 14 is a line providing $\{\alpha(E)/\alpha=0.7\}$. A line L9 shown by a broken line connecting points F, K shown in (b) of FIG. 14 is a line providing $\{\alpha(E)/\alpha=2.0\}$. A broken line GH shown in (b) of FIG. 14 shows a rotational speed which is ½ of the rotational speed of the developing sleeve 28 in the steady state during image formation. A broken line IJ shown in (b) of FIG. 14 shows a rotational speed which is ½ of the rotational speed of the first stirring screw 25 in t steady state during image formation.

Either earlier one of the drive stop signals of the motors 7,8 for rotationally driving the developing sleeve 28 and the first stirring screw 25 *s*, respectively, is outputted. Then, each of the rotational speeds of both of the developing sleeve 28 and the first stirring screw 25 becomes ½ or less of the rotational speed in the steady state during image formation. In a period until then, each of the rotational speeds of both of the developing sleeve 28 and the first stirring screw 25 is not more than the rotational speed in the steady state during image formation. And, the ratio $\alpha(E)/\alpha$ between the rotational speed ratio $\alpha$ between the developing sleeve 28 and the rotational speed of the first stirring screw 25 in the steady state and the rotational speed ratio $\alpha$ between the developing sleeve 28 and the first stirring screw 25 during drive stop may only be required to fall within the range shown in the above-described formula 3.

That is, the rotational speed of the first stirring screw 25 during drive stop may only be required to pass through side CDE without deviating from a region 38 of a hexagon ABCDEF defined by a rectilinear line AB, a rectilinear line BC, a rectilinear line CD, a rectilinear line DE, a rectilinear line EF and a rectilinear line FA, which are shown in (b) of FIG. 14 and to be decelerated and stopped.

Figure 15:
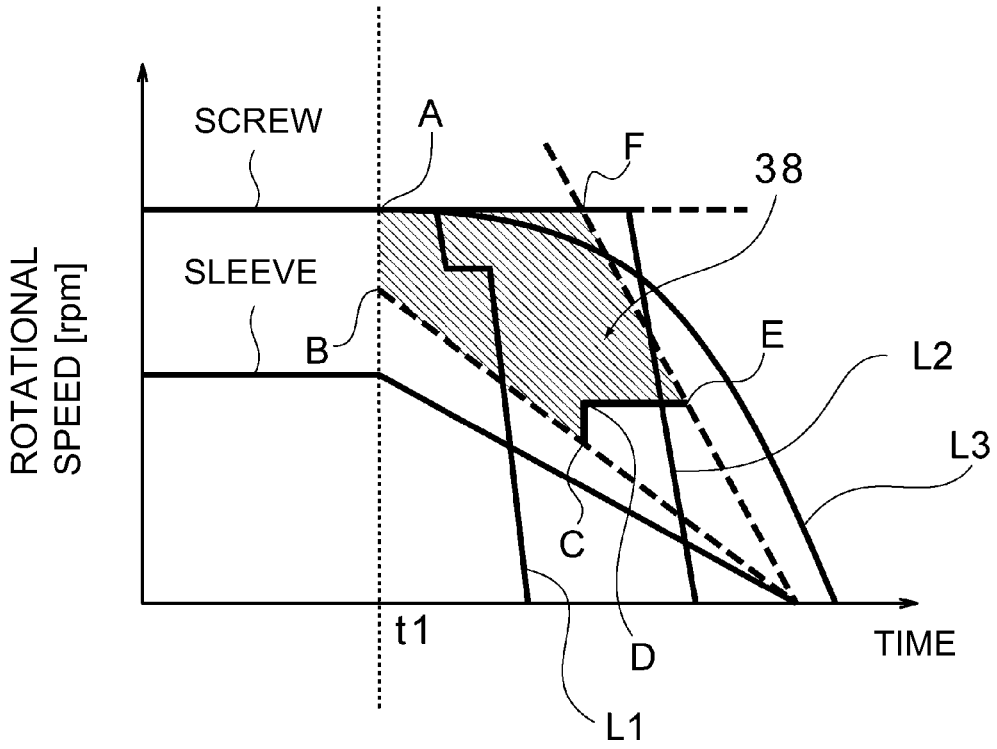
FIG. 15 is a diagram showing a change in rotational speed of the developer carrying member and the stirring member during drive stop in Comparison Examples 3 to 5.

For example, in FIG. 15, lines L1, L3 showing changes in rotational speed of the first stirring screw 25 during drive stop are Comparison Examples 3, 4 in which the rotational speed pass through sides other than the sides CDE to an outside of the region 38 of the hexagon ABCDEF, and the first stirring screw 25 is decelerated and stopped. A line L2 in Comparison Example 5 in which the rotational speed once passes through a side other than the sides CDE to the outside of the region 38 of the hexagon ABCDEF, and thereafter enters again the region 38 of the hexagon ABCDEF, and passes through the sides CDE, and the first stirring screw 25 is decelerated and stopped. Each of the lines L1 to L3 shown in FIG. 15 does not satisfy the above-described condition, and causes a large out-of-balance developer circulation during drive stop of the first stirring screw 25.

Figure 16:
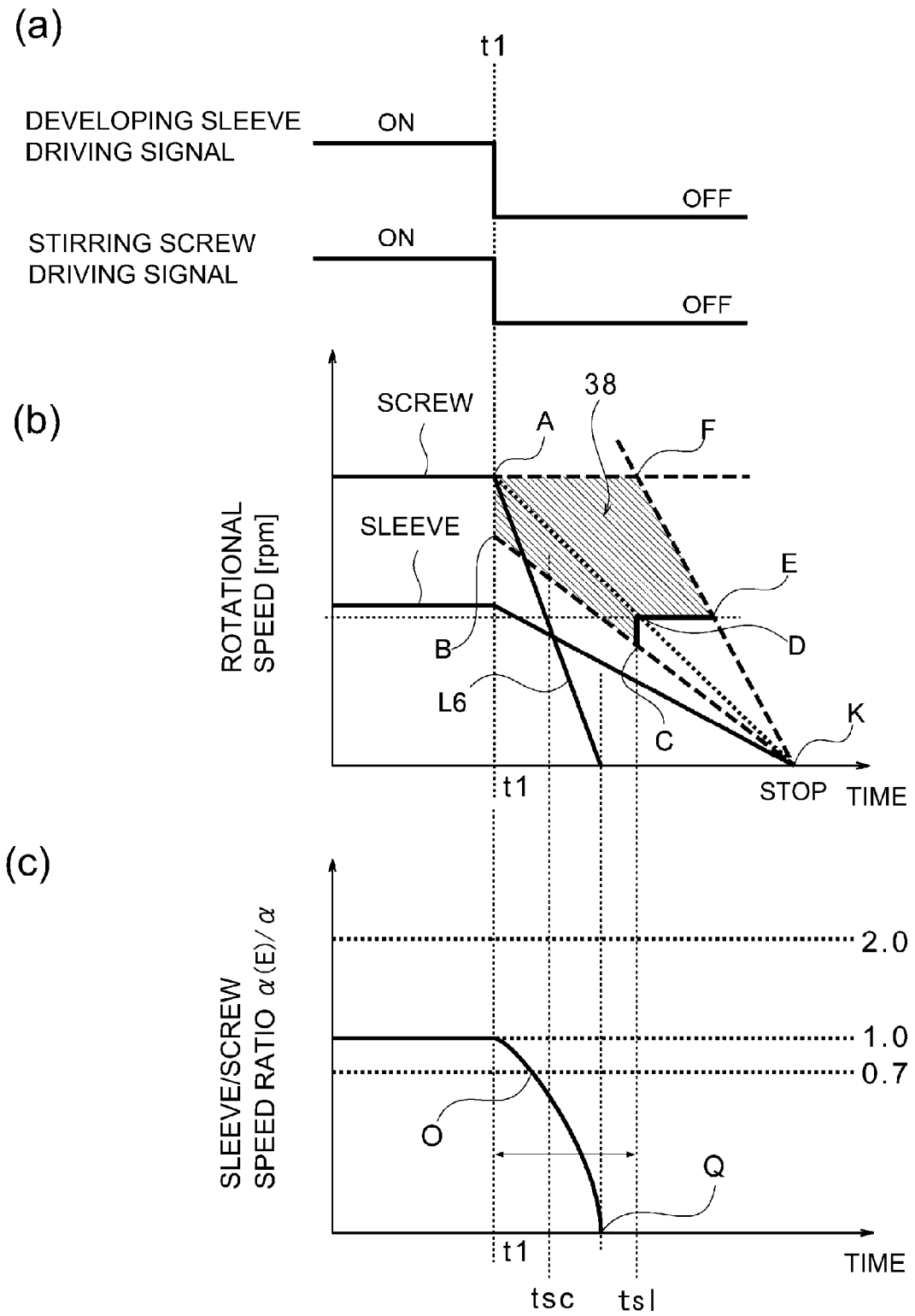
In FIG. 16, (a) is a diagram showing a drive stop signal in Comparison Example 1, (b) is a diagram showing a change in rotational speed of a developer carrying member and a stirring member during drive stop in Comparison Example 1, and (c) is a diagram showing a change in rotational speed ratio between the developer carrying member and the stirring member during drive stop in Comparison Example 1.
Figure 17:
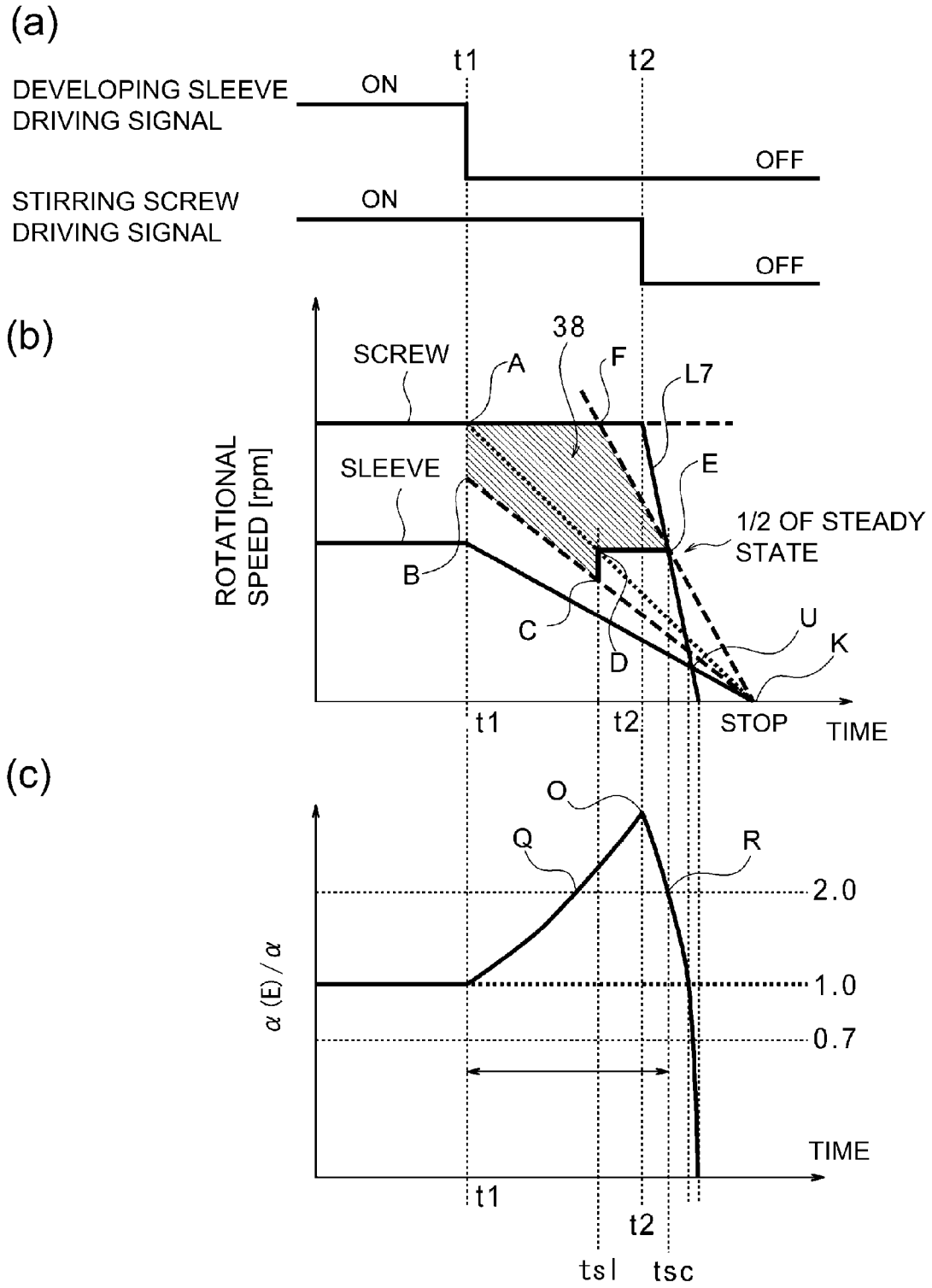
In FIG. 17, (a) is a diagram showing a drive stop signal in Comparison Example 2, (b) is a diagram showing a change in rotational speed of a developer carrying member and a stirring member during drive stop in Comparison Example 2, and (c) is a diagram showing a change in rotational speed ratio between the developer carrying member and the stirring member during drive stop in Comparison Example 2.

Further, also in Comparison Example 1 shown in FIG. 6 and in Comparison Example 2 shown in FIG. 7, as shown in (b) of FIG. 16 and (b) of FIG. 17, respectively, a line L6 passes through a side other than the sides CDE to outside of the region 38 of the hexagon ABCDEF, and the first stirring screw 25 is decelerated and stopped. A line L7 once passes through a side other than the sides CDE to the outside the region 38 of the hexagon ABCDEF and thereafter passes through the point E, and the first stirring screw 25 is decelerated and stopped. For this reason, the above-described condition is not satisfied.

Here, a time tsc shown in (c) of FIG. 16 and (c) of FIG. 17 is a time when the first stirring screw 25 has the rotational speed which is ½ of the rotational speed thereof in the steady state during image formation. Further, a time ts1 is a time when the developing sleeve 28 has the rotational speed which is ½ of the rotational speed thereof in the steady state during image formation.

Accordingly, of the drive stop signals of the motors 7, 8 for rotationally driving the developing sleeve 28 and the first stirring screw 25, respectively, either earlier one is outputted. Then, the period to the rotational speeds of both of the developing sleeve 28 and the first stirring screw 25 becoming ½ of the rotational speeds, respectively, in the steady state during image formation is as follows. In Comparison Example 1 shown in (c) of FIG. 16, the period is a period from the time t1 of generation of the drive stop signals of the developing sleeve 28 and the first stirring screw 25 to the time ts1. Further, in Comparison Example 2 shown in (c) of FIG. 17, the period is a period from the time t1 of generation of the drive stop signal of the developing sleeve 28 to the time tsc.

Accordingly, in Comparison Example 1 shown in (c) of FIG. 16, in the period from the time t1 to the time ts1, the ratio $\{\alpha(E)/\alpha\}$ between the rotational speed ratio $\alpha$ between the developing sleeve 28 and the first stirring screw 25 in the steady state and the rotational speed ratio $\alpha$ between the developing sleeve 28 and the first stirring screw 25 during drive stop is as follows. The ratio $\{\alpha(E)/\alpha\}$ is 0.7 or less along a curve (connecting points) OQ, and does not satisfy the condition shown by the above-described formula 3.

Further, in Comparison Example 2 shown in (c) of FIG. 17, in the period from the time t1 to the time ts1, the ratio $\{\alpha(E)/\alpha\}$ between the rotational speed ratio $\alpha$ between the developing sleeve 28 and the first stirring screw 25 in the steady state and the rotational speed ratio $\alpha$ between the developing sleeve 28 and the first stirring screw 25 during drive stop is as follows. The ratio $\{\alpha(E)/\alpha\}$ is 2.0 or more along a polygonal line (connecting points) QOR, and does not satisfy the condition shown by the above-described formula 3.

Figure 18:
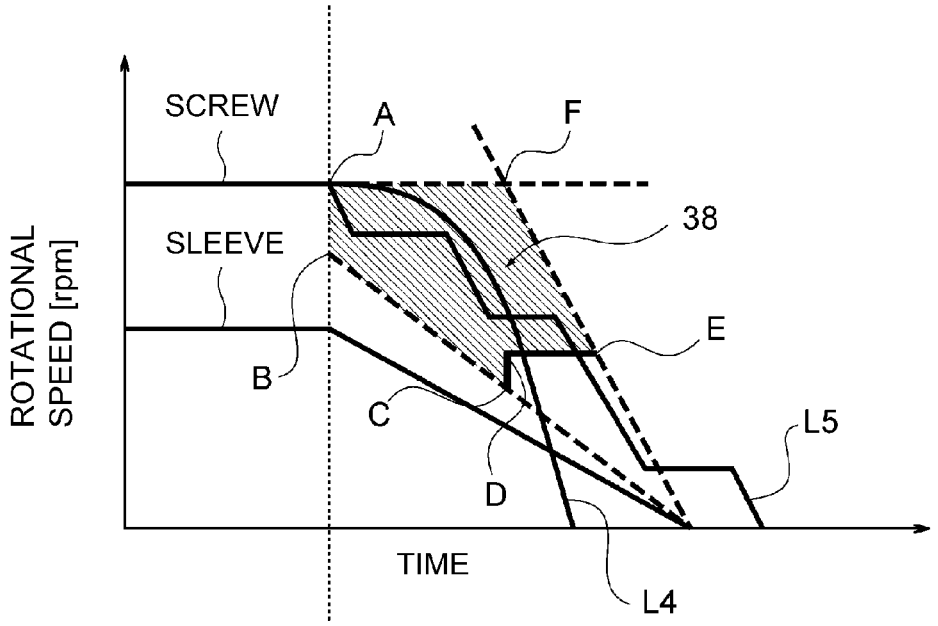
FIG. 18 is a diagram for illustrating another constitution of the present invention.
Figure 19:
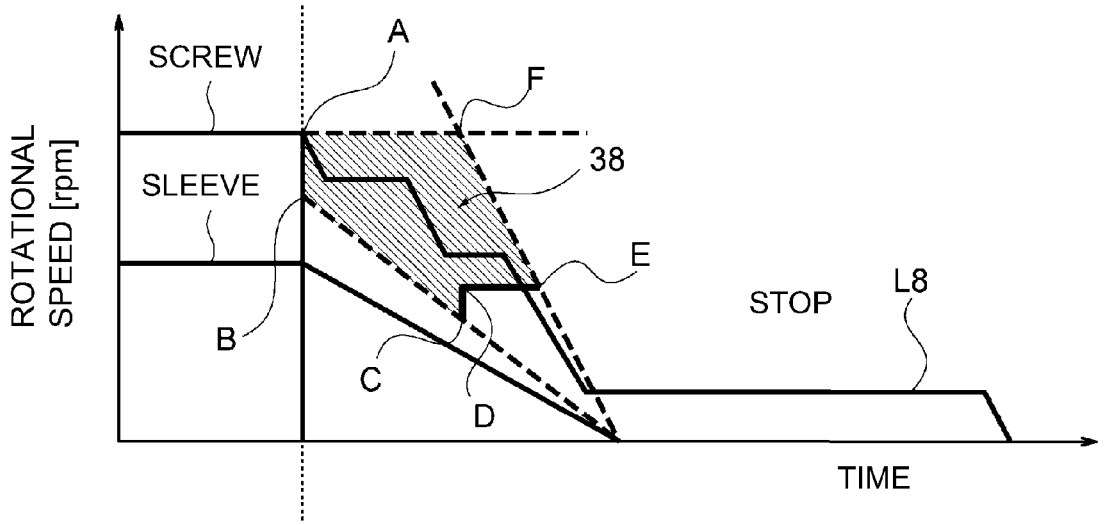
FIG. 19 is a diagram showing a change in rotational speed of a developer carrying member and a stirring member during drive stop in the Second Embodiment.
Figure 20:
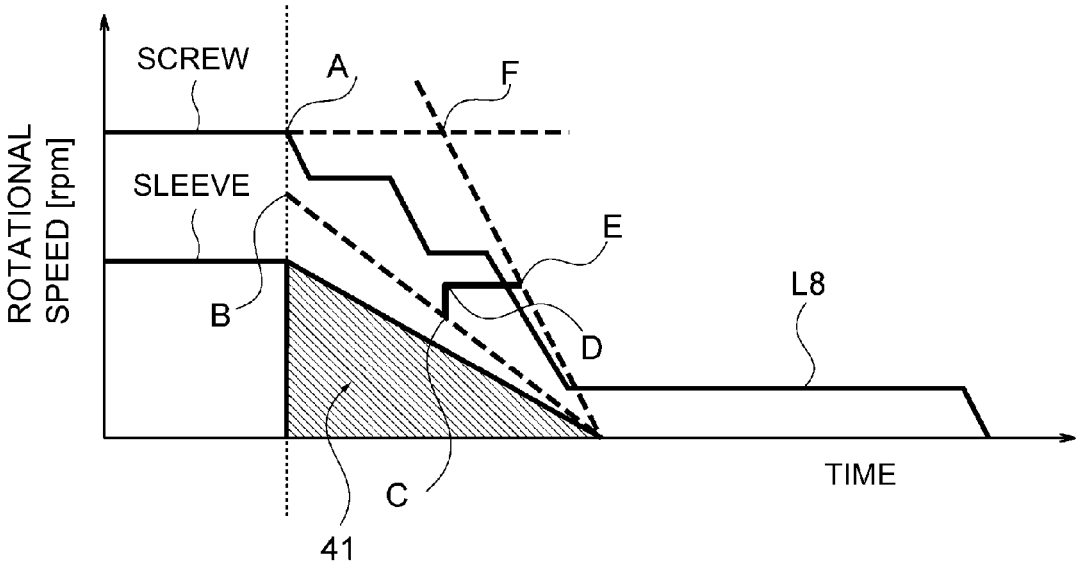
FIG. 20 is a diagram showing a change in rotational speed of a developer carrying member and a stirring member during drive stop in the Second Embodiment.
Figure 21:
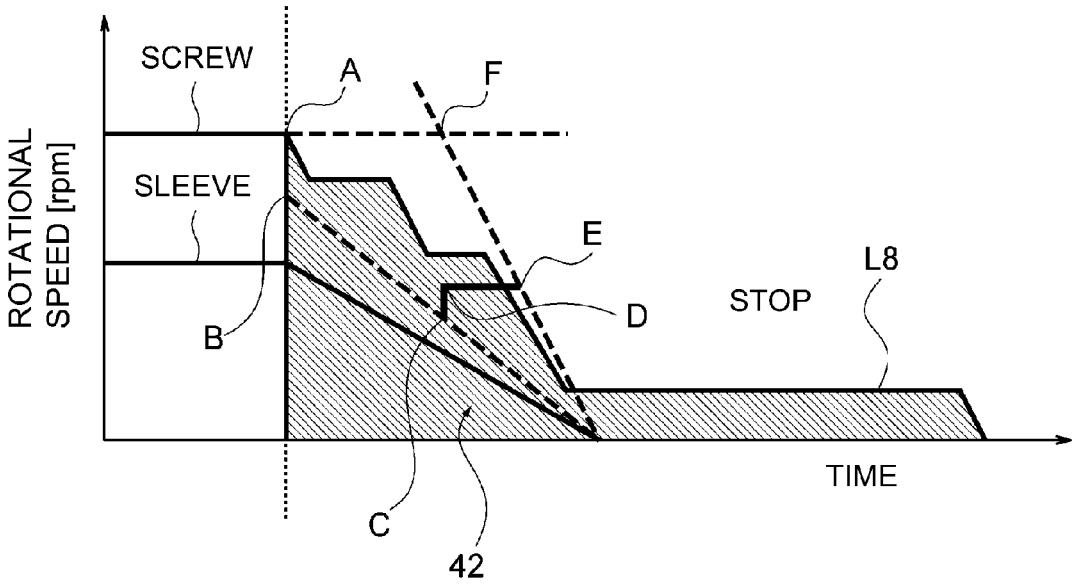
FIG. 21 is a diagram showing a change in rotational speed of a developer carrying member and a stirring member during drive stop in the Second Embodiment, and is a diagram for illustrating that $\alpha(E)/\alpha$ and in addition, preferably also $\beta(E)/\beta$ are uniformized with those during image formation.

On the other hand, in FIG. 18, each of the lines L4, L5 showing changes in rotational speed of the first stirring screw 25 during drive stop passes through the sides CDE without deviating from the region 38 of the hexagon ABCDEF, and the first stirring screw 25 is decelerated and stopped, so that the lines L4, L5 satisfy the condition shown by the above-described formula 3.

Also in this embodiment, as shown in (b) of FIG. 12, also the stepwise line L10 showing the change in rotational speed of the first stirring screw 25 during drive stop is as follows. The line L10 passes through the sides CDE without deviating from the region 38 of the hexagon ABCDEF, and the first stirring screw 25 is decelerated and stopped, so that the line L10 satisfies the condition shown by the above-described formula 3.

Incidentally, in a region where the developing sleeve 28 and the first stirring screw 25 have the rotational speeds which are ½ or less of the rotational speeds thereof in the steady state, the condition is as follows. As in the line L5 shown in FIG. 18, basically the line of the rotational speed ratio may also be one which does not satisfy the condition shown by the above-described formula 3. That is because the rotational speeds of the developing sleeve 28 and the first stirring screw 25 are small. For this reason, the rotational speeds do not have a large influence on the developer circulation. However, as in the line L8 shown in FIG. 19, when the rotational speed ratio remarkably deviates from the range shown by the above-described formula 3, there is a possibility that the rotational speed ratio has the influence on the developer circulation not a little.

Accordingly, in a further preferable example, of the drive stop signals of the developing sleeve 28 and the first stirring screw 25, either earlier one is outputted. Then, until both of the developing sleeve 28 and the first stirring screw 25 stop, the rotational frequency $\beta(E)$ between the rotational frequency of the developing sleeve 28 and the rotational frequency of the first stirring screw 25 during drive stop is as follows. The rotational frequency $\beta(E)$ may only be required to satisfy the AD formula 4 relative to the rotational frequency $\beta$ between the rotational frequency of the developing sleeve 28 and the rotational frequency of the first stirring screw 25 in the steady state. Here, the rotational frequency of the developing sleeve 28 during drive stop and the rotational frequency of the first stirring screw 25 during drive stop are represented by areas of hatched regions 41, 42, shown in FIG. 20 and FIG. 21, respectively.

Further, in this embodiment, as shown in (b) of FIG. 12, the first stirring screw 25 is stepwisely decelerated and stopped, whereby the out-of-balance developer circulation during drive stop was suppressed. As another method, the developing sleeve 28 may also be stepwisely decelerated and stopped. The out-of-balance developer circulation may also be suppressed by stepwisely decelerating and stopping both of the developing sleeve 28 and the first stirring screw 25.

<Experimental Result>

Figure 22:
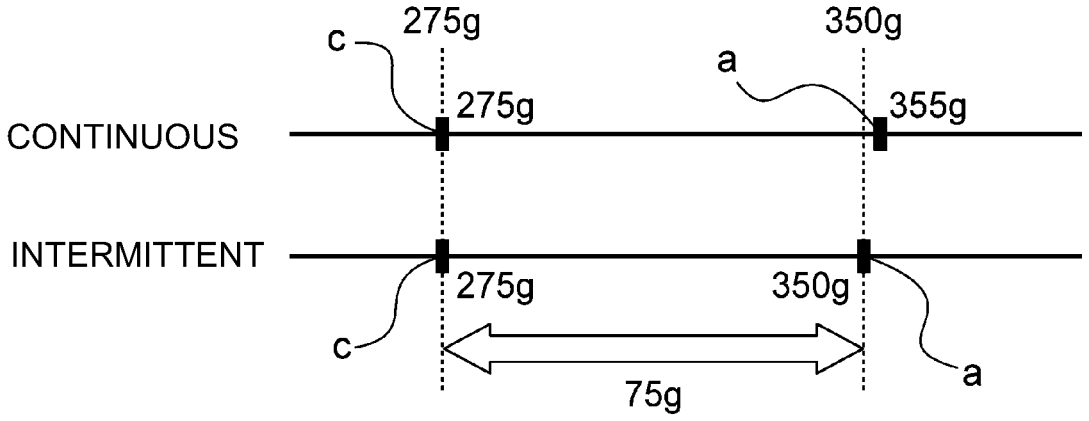
FIG. 22 is a diagram showing disorder of developer circulation during drive stop in the Second Embodiment.

Next, an experimental result of the discharging characteristic of the developer in this embodiment will be described using FIG. 22. FIG. 22 is a diagram showing the discharging characteristic of the developer in this embodiment. FIG. 22 shows a relation between a developer amount c as a limit of generation of the improper coating of the developer carried on the surface of the developing sleeve 28 and a minimum developer amount a as a lower limit of the developer amount which are shown in FIG. 4.

As shown in FIG. 22, in this embodiment, the developer amount c as the limit of generation of the improper coating of the developer carried on the surface of the developing sleeve 28 during a continuous operation, and the minimum developer amount a as the lower limit of the developer amount are as follows. Different from FIG. 9, the developer amounts are not equal to those between during continuous operation and during intermittent operation, so that the developer amounts are different in value corresponding to 5 g.

Although the developer amount change is not to the extent that it corresponds to the developer change amount of about 80 g as shown by the arrow in FIG. 9, in this embodiment, the minimum developer amount a during continuous operation is 355 g, and the minimum developer amount a during intermittent operation is 350 g, the developer amounts c as the limits of generation of the improper coating of the developer carried on the surface of the developing sleeve 28 during continuous operation and during intermittent operation were 275 g, which are substantially equal to each other.

Accordingly, also in this embodiment, during switching between during continuous operation and during intermittent operation, the amount corresponding to deterioration of the robustness against the surface of the developing sleeve 28 was merely 5 g (=355 g–350 g). By this, the change in amount of developer is about 75 g shown by an arrow in FIG. 22, so that it is possible to ensure the robustness against the improper coating of the developer carried on the surface of the developing sleeve 28. Other constitutions are similar to those in the above-described First Embodiment, so that a similar effect can be obtained.

INDUSTRIAL APPLICABILITY

According to the present invention, there is provided a developing device in which out-of-balance developer circulation is suppressed.

EXPLANATION OF SYMBOLS

7 . . . motor (first driving means)
8 . . . motor (second driving means)
25 . . . first stirring screw (first stirring member)
28 . . . developing sleeve (developer carrying member)

The invention claimed is:

1. A developing device comprising:

a developing container configured to accommodate a developer including toner and magnetic particles;

a developer carrying member rotatably provided opposed to an opening of said developing container;

a stirring member configured to stir the developer in said developing container to supply the developer to said developer carrying member;

a first driving motor configured to drive said developer carrying member;

a second driving motor configured to drive said stirring member; and a controller configured to control drive of said first driving motor and said second driving motor, wherein said controller effects control so that when a stop signal of said first driving motor and a stop signal of said second driving motor are outputted, at least in a period from output of either earlier one of the stop signal of said first driving motor and the stop signal of said second driving motor to rotational speeds of both of said developer carrying member and said stirring member becoming ½ of rotational speeds before the stop signal of said first driving motor and the stop signal of said second driving motor are outputted, the following formula is satisfied:

$$0.7<\alpha(E)/\alpha<2.0,$$

where said $\alpha(E)$ is $\omega a(E)/\omega s(E)$, wherein $\omega s(E)$ (rpm) is a rotational speed of said developer carrying member and $\omega a(E)$ (rpm) is a rotational speed of said stirring member, and where said $\alpha$ is $\omega a/\omega s$, wherein $\omega s$ (rpm) is a rotational speed of said developer carrying member in the steady state during the image formation and $\omega a$ (rpm) is a rotational speed of said stirring member in the steady state during the image formation.

2. A developing device according to claim 1, wherein said controller effects control so as to satisfy the following formula:

$$0.7<\beta(E)/\beta<1.5,$$

where said $\beta(E)$ is $Ra(E)/Rs(E)$, wherein $Rs(E)$ is a rotational frequency of said developer carrying member and $Ra(E)$ is a rotational frequency of said stirring member, and where said $\beta$ is $Ra/Rs$, wherein Rs is a rotational frequency per unit time of said developer carrying member in the steady state during the image formation and Ra is a rotational frequency per unit time of said stirring member in the steady state during the image formation.

3. A developing device according to claim 1, wherein at least one of said first driving motor and said second driving motor is a DC motor, and wherein said controller effects control so as to stepwisely change a target rotational frequency of said DC motor after the stop signal of at least one of said first driving motor and said second driving motor is outputted.

4. A developing device according to claim 1, wherein said developing container includes a first developer accommodating chamber configured to supply the developer to said developer carrying member and a second developer accommodating chamber configured to not only accommodate the developer but also collect the developer from said developer carrying member, and wherein said stirring member includes first and second stirring members provided in said first and second developer accommodating chambers, respectively, and configured to not only stir and feed the developer but also circulate the developer between said first and second developer accommodating chambers.

5. A developing device according to claim 4, wherein said first developer accommodating chamber is provided with a discharge opening configured to permit discharge of excessive developer with supply of the developer including the toner and the magnetic particles by rising of a developer surface.

6. An image forming apparatus comprising:

a developing device according to claim 1; and an image bearing member configured to carry an electrostatic latent image, wherein an image is formed by supplying a developer to the electrostatic latent image carried on said image bearing member, by said developing device.

7. An image forming apparatus comprising:

a developing device according to claim 2; and an image bearing member configured to carry an electrostatic latent image, wherein an image is formed by supplying a developer to the electrostatic latent image carried on said image bearing member, by said developing device.

8. An image forming apparatus comprising:

a developing device according to claim 3; and an image bearing member configured to carry an electrostatic latent image, wherein an image is formed by supplying a developer to the electrostatic latent image carried on said image bearing member, by said developing device.

9. An image forming apparatus comprising:
a developing device according to claim 4; and
an image bearing member configured to carry an electrostatic latent image,
wherein an image is formed by supplying a developer to the electrostatic latent image carried on said image bearing member, by said developing device.

10. An image forming apparatus comprising:
a developing device according to claim 5; and
an image bearing member configured to carry an electrostatic latent image,
wherein an image is formed by supplying a developer to the electrostatic latent image carried on said image bearing member, by said developing device.

11. A developing device according to claim 4, wherein said first developer accommodating chamber is disposed above said second developer accommodating chamber with respect to a vertical direction.

12. A developing device comprising:
a developing container configured to accommodate a developer including toner and magnetic particles;
a developer carrying member rotatably provided opposed to an opening of said developing container;
a stirring member configured to stir the developer in said developing container to supply the developer to said developer carrying member;
a first driving motor configured to drive said developer carrying member;
a second driving motor configured to drive said stirring member; and
a controller configured to control drive of said first driving motor and said second driving motor,
wherein said controller effects control so that when a stop signal of said first driving motor and a stop signal of said second driving motor are outputted, at least in a period from a stop signal of said first driving motor and a stop signal of said second driving motor to rotational speeds of both of said developer carrying member and said stirring member becoming ½ of rotational speeds before the stop signal of said first driving motor and the stop signal of said second driving motor are outputted, the following formula is satisfied:

$$0.7<\alpha(E)/\alpha<2.0,$$

where said $\alpha(E)$ is $\omega a(E)/\omega s(E)$, wherein $\omega s(E)$ (rpm)is a rotational speed of said developer carrying member and $\omega a(E)$ (rpm) is a rotational speed of said stirring member, and
where said $\alpha$ is $\omega a/\omega s$, wherein $\omega s$ (rpm) is a rotational speed of said developer carrying member in the steady state during the image formation and $\omega a$ (rpm) is a rotational speed of said stirring member in the steady state during the image formation.

13. A developing device according to claim 12, wherein said controller effects control so as to satisfy the following formula:

$$0.7<\beta(E)/\beta<1.5,$$

where said $\beta(E)$ is $Ra(E)/Rs(E)$, wherein $Rs(E)$ is a rotational frequency of said developer carrying member and $Ra(E)$ is a rotational frequency of said stirring member, and
where said $\beta$ is $Ra/Rs$, wherein Rs is a rotational frequency per unit time of said developer carrying member in the steady state during the image formation and Ra is a rotational frequency per unit time of said stirring member in the steady state during the image formation.

14. A developing device according to claim 12, wherein at least one of said first driving motor and said second driving motor is a DC motor, and wherein said controller effects control so as to stepwisely change a target rotational frequency of said DC motor after the stop signal of at least one of said first driving motor and said second driving motor is outputted.

15. A developing device according to claim 12, wherein said developing container includes a first developer accommodating chamber configured to supply the developer to said developer carrying member and a second developer accommodating chamber configured to not only accommodate the developer but also collect the developer from said developer carrying member, and wherein said stirring member includes first and second stirring members provided in said first and second developer accommodating chambers, respectively, and configured to not only stir and feed the developer but also circulate the developer between said first and second developer accommodating chambers.

16. A developing device according to claim 15, wherein said first developer accommodating chamber is provided with a discharge opening configured to permit discharge of excessive developer with supply of the developer including the toner and the magnetic particles by rising of a developer surface.

17. An image forming apparatus comprising:
a developing device according to claim 12; and
an image bearing member configured to carry an electrostatic latent image,
wherein an image is formed by supplying a developer to the electrostatic latent image carried on said image bearing member, by said developing device.

18. An image forming apparatus comprising:
a developing device according to claim 13; and
an image bearing member configured to carry an electrostatic latent image,
wherein an image is formed by supplying a developer to the electrostatic latent image carried on said image bearing member, by said developing device.

19. An image forming apparatus comprising:
a developing device according to claim 14; and an image bearing member configured to carry an electrostatic latent image,
wherein an image is formed by supplying a developer to the electrostatic latent image carried on said image bearing member, by said developing device.

20. An image forming apparatus comprising:
a developing device according to claim 15; and
an image bearing member configured to carry an electrostatic latent image,
wherein an image is formed by supplying a developer to the electrostatic latent image carried on said image bearing member, by said developing device.

21. An image forming apparatus comprising:
a developing device according to claim 16; and
an image bearing member configured to carry an electrostatic latent image,
wherein an image is formed by supplying a developer to the electrostatic latent image carried on said image bearing member, by said developing device.

22. A developing device according to claim 15, wherein said first developer accommodating chamber is disposed above said second developer accommodating chamber with respect to a vertical direction.

23. A developing device comprising:
a developing container configured to accommodate a developer including toner and magnetic particles;

a developer carrying member rotatably provided opposed to an opening of said developing container;

a stirring member configured to stir the developer in said developing container to supply the developer to said developer carrying member;

a first driving motor configured to drive said developer carrying member;

a second driving motor configured to drive said stirring member; and a controller configured to control drive of said first driving motor and said second driving motor, wherein when said developer carrying member and said stirring member which rotate after image formation are stopped, in a period in which rotational speeds of said developer carrying member and said stirring member during image formation are reduced to ½ thereof, the following formula is satisfied:

$$0.7<\alpha(E)/\alpha<2.0,$$

where said $\alpha(E)$ is $\omega a(E)/\omega s(E)$, wherein $\omega s(E)$ (rpm)is a rotational speed of said developer carrying member and $\omega a(E)$ (rpm) is a rotational speed of said stirring member, and where said $\alpha$ is $\omega a/\omega s$, wherein $\omega s$ (rpm) is a rotational speed of said developer carrying member in the steady state during the image formation and $\omega a$ (rpm) is a rotational speed of said stirring member in the steady state during the image formation.

24. A developing device according to claim 23, wherein the following formula is satisfied:

$$0.7<\beta(E)/\beta<1.5,$$

where said $\beta(E)$ is $Ra(E)/Rs(E)$, wherein $Rs(E)$ is a rotational frequency of said developer carrying member and $Ra(E)$ is a rotational frequency of said stirring member, where said $\beta$ is $Ra/Rs$, wherein $Rs$ is a rotational frequency per unit time of said developer carrying member in the steady state during the image formation and $Ra$ is a rotational frequency per unit time of said stirring member in the steady state during the image formation.

25. A developing device according to claim 23, wherein at least one of said first driving motor and said second driving motor is a DC motor, and wherein said controller effects control so as to stepwisely change a target rotational frequency of said DC motor after a stop signal of at least one of said first driving motor and said second driving motor is outputted.

26. A developing device according to claim 23, wherein said developing container includes a first developer accommodating chamber configured to supply the developer to said developer carrying member and a second developer accommodating chamber configured to not only accommodate the developer but also collect the developer from said developer carrying member, and wherein said stirring member includes first and second stirring members provided in said first and second developer accommodating chambers, respectively, and configured to not only stir and feed the developer but also circulate the developer between said first and second developer accommodating chambers.

27. A developing device according to claim 26, wherein said first developer accommodating chamber is provided with a discharge opening configured to permit discharge of excessive developer with supply of the developer including the toner and the magnetic particles by rising of a developer surface.

28. An image forming apparatus comprising:

a developing device according to claim 23; and an image bearing member configured to carry an electrostatic latent image, wherein an image is formed by supplying a developer to the electrostatic latent image carried on said image bearing member, by said developing device.

29. An image forming apparatus comprising:

a developing device according to claim 24; and an image bearing member configured to carry an electrostatic latent image, wherein an image is formed by supplying a developer to the electrostatic latent image carried on said image bearing member, by said developing device.

30. An image forming apparatus comprising:

a developing device according to claim 25; and an image bearing member configured to carry an electrostatic latent image, wherein an image is formed by supplying a developer to the electrostatic latent image carried on said image bearing member, by said developing device.

31. An image forming apparatus comprising:

a developing device according to claim 26; and an image bearing member configured to carry an electrostatic latent image, wherein an image is formed by supplying a developer to the electrostatic latent image carried on said image bearing member, by said developing device.

32. An image forming apparatus comprising:

a developing device according to claim 27; and an image bearing member configured to carry an electrostatic latent image, wherein an image is formed by supplying a developer to the electrostatic latent image carried on said image bearing member, by said developing device.

33. A developing device according to claim 26, wherein said first developer accommodating chamber is disposed above said second developer accommodating chamber with respect to a vertical direction.

* * * * *